US012331439B2

(12) United States Patent
Wang et al.

(10) Patent No.: US 12,331,439 B2
(45) **Date of Patent: *Jun. 17, 2025**

(54) PLANT PROTEIN BASED IMITATION LEATHER MATERIAL AND METHODS OF MAKING SAME

(71) Applicant: Uncaged Innovations, Inc., Troy, NY (US)

(72) Inventors: Xiaokun Wang, Troy, NY (US); Kening Lang, Troy, NY (US); Elizabeth Watson, Troy, NY (US)

(73) Assignee: Uncaged Innovations Inc, Troy, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/404,029

(22) Filed: Jan. 4, 2024

(65) Prior Publication Data

US 2024/0141564 A1 May 2, 2024

Related U.S. Application Data

(63) Continuation-in-part of application No. 18/115,401, filed on Feb. 28, 2023, which is a continuation of (Continued)

(51) Int. Cl.

| | |
|---|---|
| ***D04H 1/08*** | (2012.01) |
| ***D06N 3/00*** | (2006.01) |
| ***D06N 3/14*** | (2006.01) |

(52) U.S. Cl.

CPC ..... *D04H 1/08* (2013.01); *D06N 3/0056* (2013.01); *D06N 3/0061* (2013.01);

(Continued)

(58) Field of Classification Search

CPC ..... Y10S 428/90; D04H 1/08; D10B 2211/20; D10B 2331/10; D10B 2401/063;

(Continued)

(56) References Cited

U.S. PATENT DOCUMENTS

| | | | |
|---|---|---|---|
| 2,871,218 | A | 1/1959 | Schollenberger |
| 4,279,801 | A | 7/1981 | Kramer et al. |

(Continued)

FOREIGN PATENT DOCUMENTS

| | | | |
|---|---|---|---|
| CN | 101634109 | A | 1/2010 |
| DE | 4327024 | A1 | 2/1995 |

(Continued)

OTHER PUBLICATIONS

U.S. Appl. No. 17/665,185, filed Feb. 4, 2022 by Aaron Amstutz et al. (U.S. Patent Application is not submitted herewith pursuant to the waiver of 37 C.F.R. § 1.98(a)(2)(iii) issued by the Office on Sep. 21, 2004.).

(Continued)

*Primary Examiner* — Elizabeth M Imani

(74) *Attorney, Agent, or Firm* — Morrison & Foerster LLP

(57) ABSTRACT

A monolayer, plant protein based imitation leather material and methods of making same. Embodiments of the method comprise 1) creating a mixture of a one or more plant protein powder, a one or more non-proteinaceous polymer or toughening elastomer, a one or more plasticizer, a one or more cross-linking agent, and a one or more curing agent in an; 2) calendering the mixture into a flat, monolayer sheet at a controlled roll temperature and affixing the sheet onto a surface of a carrier fabric and 3) curing the calendered monolayer sheet by applying heat and pressure for a period of time.

15 Claims, 8 Drawing Sheets

Related U.S. Application Data application No. 17/830,314, filed on Jun. 1, 2022, now abandoned.

(60) Provisional application No. 63/292,256, filed on Dec. 21, 2021.

(52) U.S. Cl.
CPC ..... *D06N 3/0077* (2013.01); *D06N 3/14* (2013.01); *D10B 2211/20* (2013.01); *D10B 2331/10* (2013.01); *D10B 2401/063* (2013.01); *Y10S 428/904* (2013.01)

(58) Field of Classification Search
CPC .. D06N 3/0056; D06N 3/0061; D06N 3/0077; D06N 3/14
See application file for complete search history.

(56) References Cited

U.S. PATENT DOCUMENTS

| | | | | |
|---|---|---|---|---|
| 4,472,545 | A * | 9/1984 | Coughlin | D06N 3/045 524/427 |
| 5,523,293 | A | 6/1996 | Jane et al. | |
| 5,695,868 | A | 12/1997 | McCormack | |
| 5,710,190 | A | 1/1998 | Jane et al. | |
| 5,855,999 | A | 1/1999 | McCormack | |
| 5,932,497 | A | 8/1999 | Morman et al. | |
| 5,965,708 | A | 10/1999 | Bassi et al. | |
| 5,997,981 | A | 12/1999 | McCormack et al. | |
| 6,015,764 | A | 1/2000 | McCormack et al. | |
| 6,111,163 | A | 8/2000 | McCormack et al. | |
| 6,461,457 | B1 | 10/2002 | Taylor et al. | |
| 7,153,569 | B2 | 12/2006 | Kaufman et al. | |
| 8,080,617 | B2 | 12/2011 | Broos et al. | |
| 8,153,176 | B2 | 4/2012 | Etayo et al. | |
| 8,182,918 | B2 * | 5/2012 | Netravali | C08L 5/12 524/25 |
| 8,329,601 | B2 | 12/2012 | Shi et al. | |
| 8,334,225 | B2 | 12/2012 | Uemura et al. | |
| 8,765,164 | B2 | 7/2014 | Katsarava et al. | |
| 8,889,821 | B2 | 11/2014 | Otaki et al. | |
| 9,006,350 | B2 | 4/2015 | Boehm et al. | |
| 9,040,597 | B2 | 5/2015 | Woerdeman et al. | |
| 10,287,729 | B2 | 5/2019 | Casanova Royo | |
| 2005/0208294 | A1 | 9/2005 | Kaufman et al. | |
| 2006/0149199 | A1 | 7/2006 | Topolkaraev et al. | |
| 2013/0337711 | A1 | 12/2013 | Wool | |
| 2015/0013569 | A1 | 1/2015 | Domaske | |
| 2017/0233945 | A1 | 8/2017 | Purcell et al. | |
| 2021/0189642 | A1 | 6/2021 | Parth | |
| 2021/0355326 | A1 | 11/2021 | Broadbent et al. | |
| 2024/0018715 | A1 | 1/2024 | Deleage et al. | |

FOREIGN PATENT DOCUMENTS

| | | | | |
|---|---|---|---|---|
| DE | 19754418 | A1 | 6/1999 | |
| JP | 2003238810 | A | 8/2003 | |
| WO | 2002/18477 | A2 | 3/2002 | |
| WO | 2011/163461 | A1 | 12/2011 | |
| WO | 2013/087903 | A1 | 6/2013 | |
| WO | 2018/038666 | A1 | 3/2018 | |
| WO | 2019/204649 | A1 | 10/2019 | |
| WO | WO-2020102552 | A1 * | 5/2020 | A43B 1/0063 |
| WO | 2021/222755 | A1 | 11/2021 | |
| WO | 2022/079284 | A1 | 4/2022 | |

OTHER PUBLICATIONS

Wu, Q. (2017). "Biofoams and Biocomposites based on Wheat Gluten Proteins," KTH School of Chemical Science and Engineering, Department of Fibre and Polymer Technology, Doctoral Dissertation, Public Defense Aug. 25, 2017, Stockholm, Sweden, 116 pages.

Zhong, N. et al. (Apr. 5, 2013, e-pub. Jul. 3, 2012). "Preparation and Properties of Molded Blends of Wheat Gluten and Cationic Water-Borne Polyurethanes," Journal of Applied Polymer Science 128(1):460-469.

Cosgrove, L. et al. (Feb. 2010, e-pub Nov. 30, 2009). "Effect of Biostimulation and Bioaugmentation on Degradation of Polyurethane Buried in Soil," Applied and Environmental Microbiology 76(3):810-819.

Covington, A.D. (2009). "Tanning Chemistry: The Science of Leather", Royal Society of Chemistry: Cambridge, UK, 15 pages, (Table of Contents Only).

Eastoe, J.E. (Dec. 1955). "The Amino Acid Composition of Mammalian Collagen and Gelatin," Biochem J. 61(4):589-600.

Girard, A.L. et al. (Apr. 2019). "*Effects of Condensed* vs. *Hydrolysable Tannins* on Gluten Film Strength and Stability," Food Hydrocolloids 89:36-43, 35 pages.

Jayathilaka, L.P. et al. (Mar. 16, 2020). "Development of Biodegradable Natural Rubber Latex Composites by Employing Corn Derivative Bio-Fillers," Journal of Applied Polymer Science 137(40):e49205, 15 pages.

Kim, H. et al. (2021, e-pub. Feb. 7, 2021). "Comparative Study on the Physical Entrapment of Soy and Mushroom Proteins on the Durability of Bacterial Cellulose Bio-Leather," Cellulose 28:3183-3200.

Lhamo, D. et al. (Jan. 2017). "Effect of Protein Addition on Properties of Guayule Natural Rubber," Rubber Chemistry and Technology 90(2):387-404.

Reddy, N. et al. (2010, e-pub. Apr. 24, 2010). "Developing Water Stable Gliadin Films Without Using Crosslink Agents," Journal of Polymers and the Environment 18:227-283.

Roy, S. et al. (Jan. 1999). "Physical and Molecular Properties of Wheat Gluten Films Cast from Heated Film-Forming Solutions," Journal of Food Science 64(1):57-60.

Sundar, V.J. et al. (Jun. 2001). "Water Management in Leather Industry," Journal of Scientific and Industrial Research 60:443-450.

Taylor, J. et al. (Jul. 2013). "Developments in the Science of Zein, Kafirin, and Gluten Protein Bioplastic Materials," Cereal Chemistry 90(4):344-357.

Tropini, V. et al. (May 15, 2000). "Cross-Linking of Wheat Gluten Using a Water-Soluble Carbodiimide," Cereal Chemistry 77(3):333-338.

Ullsten, N.H. (Sep. 21, 2016). "Plasticizers for Protein-Based Materials," Viscoelastic and Viscoplastic Materials 5:81-101.

U.S. Appl. No. 17/665,185, filed Feb. 4, 2022 by Aaron Amstutz et al. (The U.S. Patent Application is not submitted herewith pursuant to the waiver of 37 C.F.R. § 1.98(a)(2)(iii) issued by the Office on Sep. 21, 2004.).

Vroman, I. et al. (Apr. 1, 2009). "Biodegradable Polymers," Materials 2(2):307-344.

Winnacker, M. et al. (Oct. 31, 2016). "Poly(ester amide)s: Recent Insights Into Synthesis, Stability and Biomedical Applications," Polymer Chemistry 7:7039-7046.

* cited by examiner

PLANT PROTEIN BASED IMITATION LEATHER MATERIAL AND METHODS OF MAKING SAME

RELATED APPLICATIONS

This application is a Continuation-in-Part of and claims the benefit of U.S. Non-Provisional application Ser. No. 18/115,401, filed on Feb. 28, 2023, which is a continuation of U.S. Non-provisional application Ser. No. 17/830,314, filed on Jun. 1, 2022, which claims the benefit of U.S. Provisional Application No. 63/292,256, filed Dec. 21, 2021, all of which are hereby incorporated herein by reference in their entirety.

FIELD OF INVENTION

The invention relates to a monolayer leather-like composition based on plant proteins and methods of making same. The leather-like composition is durable and has properties similar to those of natural leather that is derived from animal hide.

BACKGROUND

Leather is a strong, flexible, and durable material obtained from the tanning or chemical treatment of animal hides and used in the manufacture of many products such as clothing, fashion accessories, automobile parts, footwear, handbags, furniture, tools, sport equipment and the like. Typically, leather is obtained from the hides of land-based and aquatic animals such as cattle, sheep, goats, equines, buffalos, hogs, seals, crocodiles, alligators, and the like. The hides of mammals are composed of a thin outer layer or epidermis, a thick central layer known as dermis or corium, and a subcutaneous adipose layer. Conventional leather is obtained from the corium after the epidermis and the adipose layers are removed. Fresh hides contain about 60-70% water and 30-35% protein, 85% of which is collagen. Collagen is the main component of connective tissues in mammals.

The combination of a rising demand for leather products and the expensive and labor-intensive as well as lengthy process of making leather have led to an increase in the price of leather products. In addition, the leather making industry has been condemned by animal right organizations and activists for the ongoing animal slaughter to harvest the skin. Both factors have led to an increase in demand for a substitute material to conventional leather that can be made mostly from green materials.

Although various attempts at creating leather-like fabrics or materials have achieved some limited success, prior attempts have had one or more drawbacks, such as, for example, combustion on exposure to flames, lack of flexibility, non-leather like properties, comprising non-renewable and non-biodegradable materials, or formed in or comprising multiple layers. Therefore, an object of the invention is to provide a monolayer (single layer) imitation leather material or composition made mostly of renewably produced plant proteins, having the appearance and characteristics of natural leather, and obtainable by a cost effective and simple process without the use of any reducing agent.

As used throughout this disclosure, the term "monolayer imitation leather composite material," "monolayer imitation leather," "monolayer leather," "imitation leather" and various derivative expressions thereof, may be used all of which all refer to the invention described herein and comprising all of these characteristics, i.e., a monolayer (single layer) imitation leather composite material made mostly of renewably produced plant proteins and having the appearance and characteristics of natural leather that is further created by a cost effective and simple process without the use of any reducing agent.

SUMMARY OF THE INVENTION

The invention the subject of this disclosure encompasses several aspects. In one aspect, embodiments of the invention are directed to a method or process of creating a monolayer imitation leather composite material. In another aspect, embodiments of the invention are directed to the composition of the imitation leather material. In yet a third aspect, the invention is directed to various products or goods made from the imitation leather material, such as, for example, consumer goods, products and accents typically made from natural leather.

In an embodiment, the invention is directed to a method or process of producing or creating a monolayer imitation leather composite material, wherein said method generally comprises three primary steps: 1) creating a mixture (composition) by combining and mixing together a one or more plant protein powder in an amount of at least 70% (w/w), wherein the protein content of the powder comprises an amount in a range from about 28% (w/w) to about 65% (w/w), and wherein the one or more plant protein comprises wheat gluten, brown rice protein, barley protein, maize protein, or any combination thereof, a one or more non-proteinaceous polymer or toughening elastomer in an amount in a range from about 25% (w/w) to 50% (w/w), a one or more plasticizer in an amount in a range from about 8% (w/w) to about 25% (w/w), a one or more cross-linking agent in an amount in a range of about 1% (w/w) to about 5% (w/w) (with respect to the weight of the protein content of the one or more plant protein powder, i.e., crosslinking agent/plant protein ratio, based on the specific one more plant protein powder used), and a one or more curing agent in an amount in a range from about 1% (w/w) to about 10% (w/w) (with respect to the weight of the one or more non-proteinaceous polymer); 2) calendering the mixture into a flat, monolayer sheet, wherein the calendering is conducted at a controlled roll temperature from 35° C. to 90° C., wherein the calendered monolayer sheet is applied to or affixed onto a surface of a carrier fabric and wherein the monolayer sheet comprises a thickness in a range from about 0.5 to 5 mm; and 3) curing the calendered monolayer sheet by applying heat at a temperature in a range from about 100° C. to about 160° C., at pressure in a range from about 0.3 Mpa to 5 Mpa pressure, and for a period of time in a range from about 10 minutes to about 60 minutes. In an embodiment, the method may be used to produce or create an imitation leather material having a thickness in a range from about 0.5 mm to about 5.0 mm, a tensile strength in a range of about 1.0 Mpa to about 15 Mpa, and an elongation at break in a range of about 20% to about 200%, a tear resistance in a range from about 100 psi to 500 psi, and a Bally flex resistance in range from about 20,000 cycles to about 200,000 cycles. As detailed herein, the invention comprises multiple embodiments and variations of this process and this particular disclosed embodiment should not be construed as limiting the scope of the method or the imitation leather material created by the method.

In an embodiment, the one or more non-proteinaceous polymer may comprise polymethyl acrylic acid, polyurethane, polyurethane-polyamide copolymer, polyurethane-polyester copolymer, polyacrylic acid-polyester copolymer, polyacrylic acid-polyamide copolymer, or any combination thereof.

In an embodiment, the one or more non-proteinaceous polymer may comprise natural rubber latex and/or natural rubber. In another embodiment, the one or more non-proteinaceous polymer may comprise natural rubber latex and/or a bio-based polyurethane. In an embodiment, the bio-based polyurethane may comprise polyester-polyurethane co-polymer and/or polyamide-polyurethane co-polymer.

In an embodiment, the one or more non-proteinaceous polymer may comprise technically specified or block natural rubber (TSR), ribbed smoked sheet natural rubber (RSS), high ammonia natural rubber latex concentrate, low ammonia natural rubber latex concentrate, deproteinized natural rubber latex concentrate with a dry rubber content in a range of about 50% to about 62%, waterborne polyurethane-polyester copolymer, polyurethane-polycarbonate copolymer, polyurethane-polyether copolymer, or any combination thereof.

In an embodiment, the one or more plasticizer or plasticizer agent may comprise glycerin, sorbitol, polyol, and/or derivatives thereof, urea and/or derivatives thereof, polyethylene glycol 400-4000, vegetable oil, vulcanized vegetable oil and/or derivatives thereof, or any combination thereof.

In an embodiment, a one or more lubricant or lubrication agent may be combined and mixed into the mixture, wherein a combined amount of the one or more lubricating agent and the one or more plasticizer is in a range from about 8% (w/w) to about 25% (w/w). In an embodiment, the lubricant may comprise natural wax, synthetic wax, fatty alcohol dicarboxylic acid ester, fatty acid, or any combination of the foregoing, all which may be added in combination with an at least one surfactant.

In an embodiment, the one or more crosslinking agent may comprise dialdehyde, diimidate esters of dicarboxylic acids, dicarboxylic acid esters of N-hydroxysuccinamide, carbonyldiimidazol, polycarbodiimide, dimaleimide, dichlorotriazine, or any combination thereof. The one or more crosslinking agent crosslinks molecules comprising the one or more plant protein. In various embodiments, the amount of the one or more crosslinking agent may comprise an amount in a range from about 1% (w/w) to about 10% (w/w) with respect to the amount of the one or more plant protein (i.e., crosslinking agent/plant protein ratio), based on the specific one more plant protein used.

In an embodiment, the one or more curing agent may comprise a vulcanization agent, comprising a one or more of a peroxide curing agent, a sulfur-based curing agent, stearic acid, zinc oxide, disulfiram (tetraethylthiuram disulfide or TETD), mercaptobenzothiazole disulfide (MBTS), sulfur, or any combination thereof. The one or more curing agent crosslinks molecules comprising the one or more non-proteinaceous polymer. In various embodiments, the amount of the one or more curing agent may comprise an amount in a range from about 1% (w/w) to about 10% (w/w) with respect to the weight of the one or more non-proteinaceous polymer (i.e., curing agent/polymer ratio), based on the specific one more non-proteinaceous polymer used.

In an embodiment, the method or process of creating the monolayer imitation leather composite material may comprise the additional step of applying a coating of a one or more finishing material or agent to a surface of the monolayer leather material, wherein the one or more finishing material may be comprised of polyurethane, polyurethane-polyester, acrylic resin, a cellulose ester (such as cellulose acetate, cellulose propionate, and/or cellulose butyrate), or any combination thereof. The finishing agent or material may be pigmented (i.e., comprise a pigment, dye or coloring material or agent) to add color to the imitation leather.

In an embodiment, the method or process of creating the monolayer imitation leather material may comprise the additional step embossing a surface of the monolayer leather material with different leather patterns based on naturally occurring leather patterns, such as, but not necessarily limited to, that of bovine, goat, alligator, crocodile, and reptile skin patterns.

A second aspect of the invention is directed to a monolayer imitation leather material comprising 1) a one or more plant protein powder comprising an at least 70% (w/w), wherein the plant protein powder is comprised of a protein content in an amount in a range from about 28% (w/w) to about 65% (w/w), and wherein the one or more plant protein comprises wheat gluten, brown rice protein, barley protein, maize protein, or any combination of the foregoing, 2) a one or more non-proteinaceous polymer or toughening elastomer in an amount in a range from about 25% (w/w) to about 50% (w/w), 3) a one or more plasticizer in an amount in a range from about 8% (w/w) to about 25% (w/w), 4) a one or more cross-linking agent in an amount in a range from about 1% (w/w) to about 5% (w/w) (with respect to the weight of the protein content of the one or more plant protein powder, i.e., crosslinking agent/plant protein ratio, based on the specific one more plant protein used), and 5) a one or more curing agent in an amount in a range from about 1% (w/w) to about 10% (w/w) (with respect to the weight of the one or more non-proteinaceous polymer, i.e., curing agent/polymer ratio, based on the specific one more non-proteinaceous polymer used).

In an embodiment, the one or more non-proteinaceous polymer may comprise polymethyl acrylic acid, polyurethane, polyurethane-polyamide copolymer, polyurethane-polyester copolymer, polyacrylic acid-polyester copolymer, polyacrylic acid-polyamide copolymer, or any combination of the foregoing.

In an embodiment, the one or more non-proteinaceous polymer may comprise natural rubber latex and/or natural rubber. In an embodiment, the one or more non-proteinaceous polymer may comprise natural rubber latex and/or a bio-based polyurethane. In yet another embodiment, the bio-based polyurethane may comprise polyester-polyurethane co-polymer and/or polyamide-polyurethane co-polymer. In various embodiments, the one or more non-proteinaceous polymer may comprise any combination of the foregoing polymers.

In an embodiment, the one or more plasticizing agent may comprise glycerin, sorbitol, polyol, and/or derivatives thereof, urea and/or derivatives thereof, polyethylene glycol 400-4000, vegetable oil, vulcanized vegetable oil and/or derivatives thereof, or any combination of the foregoing.

In an embodiment, a one or more lubrication agent or lubricant may be combined and mixed into the mixture, wherein a combined amount of the lubricating agent and the one or more plasticizer is in a range from about 8% (w/w) to about 25% (w/w). In an embodiment, the one or more lubricant may comprise natural wax, synthetic wax, fatty alcohol dicarboxylic acid ester, fatty acid, or any combination of the foregoing, all which may be added in combination with an at least one surfactant.

In an embodiment, the one or more crosslinking agent may comprise dialdehyde, diimidate esters of dicarboxylic acids, dicarboxylic acid esters of N-hydroxysuccinamide, carbonyldiimidazol, polycarbodiimide, dimaleimide, dichlorotriazine, or any combination thereof.

In an embodiment, the one or more curing agent may comprise a vulcanization agent, comprising a one or more of a peroxide curing agent, a sulfur-based curing agent, stearic acid, zinc oxide, disulfiram (tetraethylthiuram disulfide or TETD), mercaptobenzothiazole disulfide (MBTS), sulfur, or any combination thereof.

In an embodiment, the method or process of creating the monolayer imitation leather composite material may comprise the additional step of applying a coating of a one or more finishing material or agent to a surface of the monolayer leather material, wherein the one or more finishing material may be comprised of polyurethane, polyurethane-polyester, acrylic resin, a cellulose ester (such as cellulose acetate, cellulose propionate, and/or cellulose butyrate), or any combination thereof. The finishing agent or material may be pigmented to add color to the imitation leather.

In an embodiment, the monolayer imitation leather may be embossed with different leather patterns based on naturally occurring leather patterns, such as, but not necessarily limited to, that of bovine, goat, alligator, crocodile, and reptile skin patterns.

In various embodiments, the monolayer imitation leather material comprises a thickness in a range from about 0.5 mm to about 5.0 mm, a tensile strength in a range from about 1.0 Mpa to 15 Mpa, an elongation at break in a range from about 20% to about 200%, a tear resistance in a range from about 100 psi to about 500 psi, and a Bally flex resistance in a range from about 20,000 cycles to about 200,000 cycles.

A third aspect of the invention is directed to embodiments comprising various consumer products or goods created, fabricated, produced, or manufactured from or otherwise using one or more embodiments of the monolayer imitation leather composite material comprising the invention in the same or similar fashion as natural leather may be used. In an embodiment, the monolayer imitation leather composite material may be crafted or used to create various products such as those that are crafted with natural leather. Such products include, but are not limited to, footwear, fashion accessories, such as, but not limited to, handbags, briefcases, belts, clothing items—any accessory of which natural leather may be used. In addition, the monolayer imitation leather composite material may be used to create, craft, or highlight furniture, automobile interior appointments and the like.

BRIEF DESCRIPTION OF FIGURES

A brief description of the drawings now follows.

DETAILED DESCRIPTION

Figure 1:
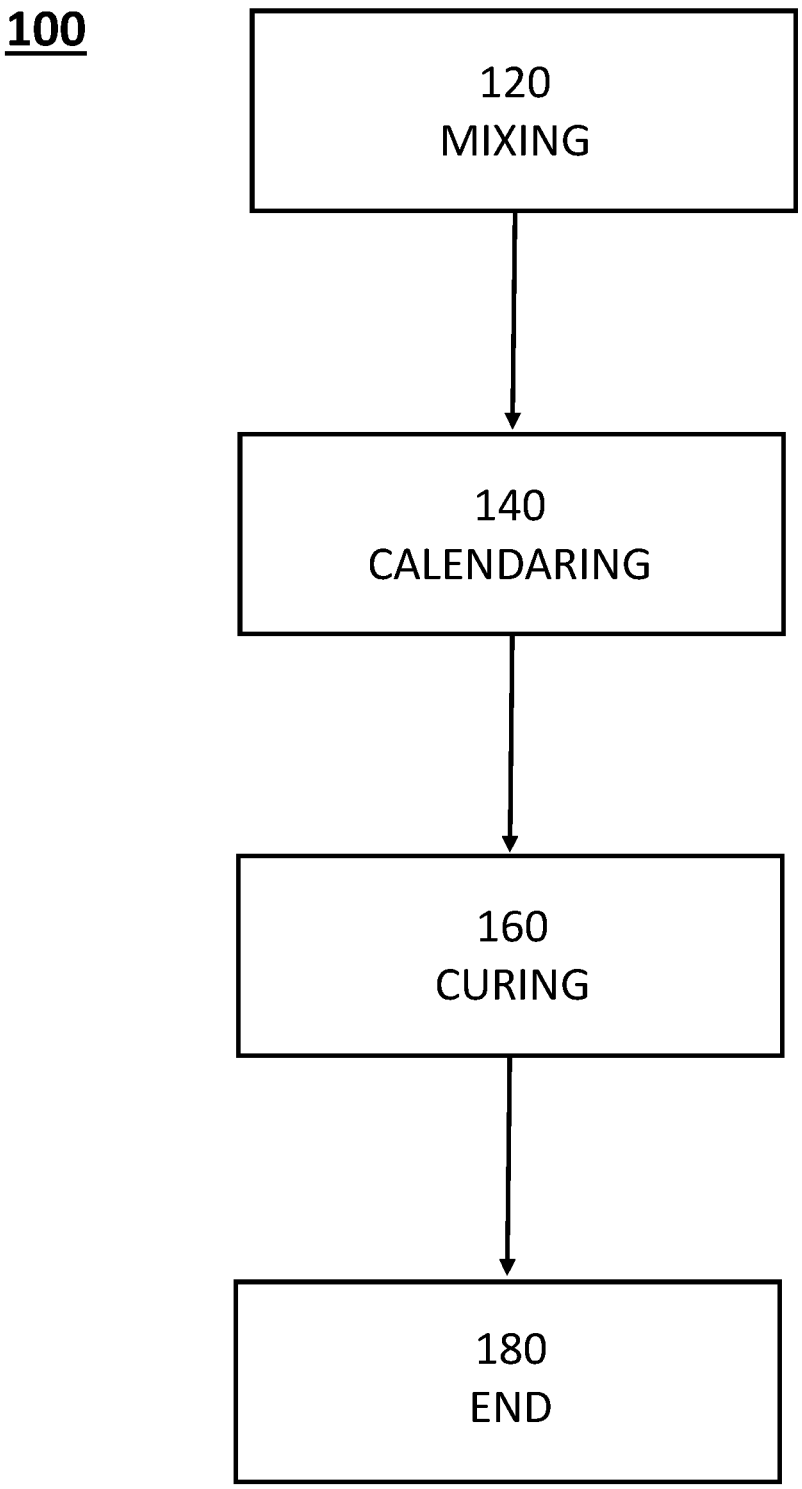
FIG. 1 depicts method 100 of an embodiment of the invention.

Reference is now made in detail to specific embodiments of the invention. Various embodiments are illustrated in the drawings.

Several aspects of the invention are described herein with reference to example applications for illustration. It should be understood that numerous specific details, relationships, and methods are set forth to provide a full understanding of the features described herein. One having ordinary skill in the relevant art, however, will readily recognize that the features described herein can be practiced without one or more of the specific details or with other methods. The features described herein are not limited by the illustrated ordering of acts or events, as some acts can occur in different orders and/or concurrently with other acts or events, unless otherwise specifically indicated. Furthermore, not all illustrated acts or events are required to implement a methodology in accordance with the features described herein.

The terminology used herein is for the purpose of describing exemplary embodiments only and is not intended to be limiting. As used herein, the singular forms "a", "an" and "the" are intended to include the plural forms as well, unless the context clearly indicates otherwise. Furthermore, to the extent that the terms "including", "includes", "having", "has", "with", or variants thereof are used in either the detailed description and/or the claims, such terms are intended to be inclusive in a manner similar to the term "comprising".

As used herein, the term "plant protein" refers to any protein obtained from any plant source, such as, but not limited to, wheat, beans, rice, barley, soybeans, peas, lentil, maze and the like.

As used herein, the term "biodegradable" refers to a material that is capable of being decomposed by bacteria or other living organisms.

As used herein, the term "non-proteinaceous polymer" refers to any natural or man-made polymer that contains no more than five different proteinaceous a-L-amino acids, for example, a-L-amino acids such as, but not limited to, polyglycine, polylysine, poly-aspartic acid, poly-cysteine, polyglutamic acid and any poly racemic- or D-amino acids and the like, as well as isomers and thereof. All such polymers are considered polyamides non-proteinaceous polymers for purposes of this disclosure.

As used herein, the terms "latex" and "rubber" are used interchangeably having the same meaning and include natural or synthetic rubber, e.g., polymerized isoprene (polyisoprene or cis-1,4-polyisoprene) unless specifically stated to the contrary.

As used herein, the term "in an amount in a range from about X % to about Y %" (and any other similar phrases) comprises all sub-ranges within the range. For example, a protein in an amount in a range from about 40% (w/w) to about 70% (w/w) would comprise the sub-ranges from about 41% (w/w) to about 70% (w/w), about 41% (w/w) to about 69% (w/w), about 45% (w/w) to about 65% (w/w), about 46% (w/w) to about 66% (w/w) . . . etc.

As used herein, the amount of protein in a composition is the calculated amount of protein in the protein powder. For example, 100 g of protein powder comprising 75% protein content has 75 g of protein. Also, the amount of protein may be determined in a commercial protein powder preparation spectrophotometrically at wavelength of 280 nm or by reaction with coloring reagents by well-known methods in the art and measuring the absorption at the appropriate wavelength, or by any other methods known in the art for determining the amount of protein in a protein powder.

Turning to a first aspect of the invention, an embodiment is directed to a method or process of making a monolayer imitation leather material. The method generally comprises the steps of 1) combining and mixing a one or more plant protein powder, a one or more non-proteinaceous polymer, a one or more plasticizer, a one or more crosslinker or crosslinking agent, and a one or more curing agent, all in various amounts, combinations and ratios, 2) calendering the mixture into a flat monolayer sheet, wherein the calendering is conducted at a controlled heated roll temperature, the calendered monolayer sheet is applied or affixed to a surface of a carrier fabric, and the calendered monolayer sheet is of a desired thickness, and 3) curing the calendered monolayer sheet at a heated temperature range, under a specified pressure and for a period of time.

In an embodiment, the method comprises: 1) creating a mixture by combining and mixing together a one or more plant protein powder in an amount of at least 70% (w/w), wherein the protein content of the one or more plant protein powder comprises an amount in a range from about 28% (w/w) to about 65% (w/w), and wherein the plant protein comprises wheat gluten, brown rice protein, barley protein, maize protein, or any combination thereof, a one or more non-proteinaceous polymer or toughening elastomer in an amount in a range from about 25% (w/w) to 50% (w/w), a one or more plasticizer in an amount in a range from about 8% (w/w) to about 25% (w/w), a one or more cross-linking agent in an amount in a range of about 1% (w/w) to about 5% (w/w) (with respect to the weight of the protein content of the one or more plant protein, i.e., crosslinking agent/plant protein ratio, based on the specific one more plant protein used), and a one or more curing agent in an amount in a range from about 1% (w/w) to about 10% (w/w) (with respect to the weight of the one or more non-proteinaceous polymer, i.e., curing agent/polymer ratio, based on the specific one more non-proteinaceous polymer used); 2) calendering the mixture into a flat, monolayer sheet, wherein the calendering is conducted at a controlled roll temperature from 35° C. to 90° C., wherein the calendered monolayer sheet is applied to or affixed onto a surface of a carrier fabric and wherein the monolayer sheet comprises a thickness in a range from about 0.5 to 5 mm; and 3) curing the calendered monolayer sheet by applying heat at a temperature in a range from about 100° C. to about 160° C., at pressure in a range from about 0.3 Mpa to 5 Mpa pressure, and for a period of time in a range from about 10 minutes to about 60 minutes. In an embodiment, the method may be used to produce or create an imitation leather material having a thickness in a range from about 0.5 mm to about 5.0 mm, a tensile strength in a range of about 1.0 Mpa to about 15 Mpa, and an elongation at break in a range of about 20% to about 200%, a tear resistance in a range from about 100 psi to 500 psi, and a Bally flex resistance in range from about 20,000 cycles to about 200,000 cycles. As detailed herein, the invention comprises multiple embodiments and variations of this process and this particular disclosed embodiment should not be construed as limiting the scope of the method or the imitation leather material created by the method.

Plant Protein Powder. The one or more plant protein powder suitable for use in embodiments of the method may be any protein powder from any plant. Many plant protein powders commercially available may be used, for example, from grains such as, but not limited to, wheat, and derivatives thereof, such as, for example, wheatberries, durum, emmer, semolina, spelt, farina, farro, graham, Khorasan wheat, einkorn wheat and the like; rye; barley; triticale; maize; soybean; pea; beans such as fava beans; lentil, soybean, and the like. Many plant protein powders such as wheat gluten, soy protein, pea protein and the like are commercially available and may be used. Suitable plant protein powders ideally would comprise an at least 60% protein content, preferably an at least 65% protein content to an at least 75% protein content, and most preferably an at least 80% or more protein content.

In an embodiment, the one or more plant protein powder may comprise a prolamin, which is a type of plant storage protein. Prolamins are a group of plant storage proteins having a high proline and glutamine content, are further characterized as having poor solubility in water, and are found in plants, mainly in the seeds of cereal grains such as wheat, barley, rye, maize, sorghum, and oats; and may be referred to as gluten. Gluten is a water insoluble mixture of prolamins. For example, wheat gluten is composed of mainly two types of proteins: glutenins and gliadins, which in turn may be divided into high molecular and low molecular glutenins and α/β, γ and Ω gliadins. Wheat gluten's homologous seed storage proteins in barley are referred to as hordein; in rye, secalin; in oats, avenin and in sorghum, kafirin. The storage proteins in other grains, such as maize (corn) for example is known as zein, and zein and the storage protein of rice are sometimes referred to as gluten, as well. All such plant proteins are suitable for use in embodiments of the invention.

Continuing with the method, in an embodiment, the mixture may comprise a one or more plant protein powder in an amount in a range from about 30% (w/w) to about 90% (w/w), preferably in an amount in a range from about 45% (w/w) to about 75% (w/w), and even more preferably in an amount in a range from about 50% (w/w) to about 60% (w/w). In an embodiment, the amount of protein content in the plant protein power comprises an amount in a range of from about 48% to about 55%, preferably in an amount in a range from about 49% to about 53%, and most preferably in an amount in a range from about 49% to about 52%.

Non-Proteinaceous Polymer. The one or more non-proteinaceous polymer are generally well-known in the art and commercially available from many suppliers and may be engineered for specific applications. Non-proteinaceous polymers have many uses, see, for example, Vroman and Tighzert [(2009) Material (Basel) 2(2) 307-344, incorporated herein by reference in its entirety. The one or more non-proteinaceous polymer may comprise both renewable polymers and synthetic polymers.

Renewable polymers are biodegradable and obtained from plants, algae, fungi, and bacteria. Examples of renewable polymers suitable for embodiments of the invention include, but are not limited to, β-polyhydroxyalkanoate (polyesters), including, but not limited to, poly(hydroxybutyrate), natural rubber and derivatives thereof, natural rubber latex (an emulsion of natural rubber microparticles in water), and poly(hydroxybutyrate-co-hydroxyvalerate).

Synthetic polymers are a larger group of polymers and may also be divided into two groups: biodegradable polymers and biodegradable resistant polymers. Generally, biodegradable synthetic polymers suitable for use in embodiments of the invention include, but are not necessarily limited to, hydrolysable backbone polymers, such as aliphatic polyesters, comprising, but not limited to, polylactic acid, polyhydroxy propylene, and (polylactic-co-glycolic acid), aromatic-aliphatic co-polyesters, polyamides, poly-amide-polyester co-polymers, poly(ester-urethane) and polycarbonates. Additional synthetic biodegradable polyesters (biodegradable synthetic polymers) suitable for use in embodiments of the invention include, but are not limited to polyglycolide, polylactide, poly(lactide-co-glycolide), polycaprolactone, poly(butylene succinate) and its co-polymers, poly(p-dioxanone), poly(butylene succinate), poly(ethylene succinate), poly(butylene succinate-co-adipate), polycarbonate and the like. Examples of polyamides include, but are not limited to, poly-a-amino acid such as polylysine, polyaspartic acid, polyglutamic acid, polyproline, polyglycine, and the like, poly(succinic acid-tetramethylenediamine), poly(succinic acid-pentamethylenediamine), poly (succinic acid-hexamethylenediamine), poly(succinic acid-polycaprolactam), and the like. Polyamide-polyester co-polymers, also known as polyester-amides, are durable and more readily biodegradable than polyamides. Polyamide-polyester co-polymers are hybrid polymers containing both ester and amide linkages such as, for example, copolymerization of hydroxy acids and amino acids, glycol, lactones, and lactams such as aminocaproic acid, and caprolactam, and the like. Another class of hybrid polymer which has suitable characteristics for use in embodiments of the invention is poly(ester-urethane), also known as poly(ester-urea). Suitable poly(ester-urethane) polymers are commercially available from various vendors such as Mitsui Takeda Chemicals, Inc under the trademark TAKELAC™; the Liofol Company, which is a division of Henkel Technologies of Dusseldorf, Germany, under the trademark TYCEL™; Rohm and Haas Chemicals L.L.C., LTD of Delaware, under the trademark ADCOTE™; and from UPACOp Adhesives Inc. of Massachusetts under the trademark UNOVERS™. Another biodegradable polymer which may be suitable for use in embodiments of the invention is polyvinyl alcohol and derivatives thereof such as but not limited to acetate. All of the above mentioned biodegradable polymers may be suitable for use in embodiments of the invention as the one or more non-proteinaceous polymer.

Biodegradable resistant polymers may also be suitable for use in various embodiments as the one or more non-proteinaceous polymer. Examples of such polymers are well-known in the art and include, but are not limited to, vulcanized rubber, vulcanized rubber latex, polyacrylic acid and derivatives thereof, polymethyl-acrylic acid and derivatives thereof, polyether such as polyethylene glycol (PEG), also known as polyethylene oxide, polypropylene glycol, poly(ethylene glycol co propylene glycol) and the like, polyurethane, polymethacrylate, polyvinyl pyrrolidone, polyacrylic acid, polymethyl acrylic acid, and the like.

Embodiments of the invention may comprise one or more of any of the aforementioned non-proteinaceous polymers in various amounts and ratios as further described in this disclosure.

In an embodiment, the mixture may comprise a one or more non-proteinaceous polymer in an amount in a range from about 10% (w/w) to about 50% (w/w), preferably in an amount in a range from about 15% (w/w) to about 45% (w/w), and most preferably in an amount in a range from about 25% (w/w) to about 40% (w/w).

In an embodiment, the mixture may comprise a two or more non-proteinaceous polymers in an amount in a range from about 5% (w/w) to about 15% (w/w), preferably in an amount in a range from about 8% (w/w) to about 12% (w/w), and most preferably in an amount in a range from about 7% (w/w) to about 10% (w/w), wherein the amount of protein content comprising the mixture is an amount of at least 61% (w/w) and preferably in an amount of at least 70% (w/w) or more of a total amount of the protein and the optionally one or more non-proteinaceous polymers.

Plasticizer. The one or more plasticizer or plasticizer agent suitable for use in embodiments of the invention is any substance that, when added to the mixture, results in a softer and more flexible finished composite leather material, and that further increases the finished material's plasticity, decreases the viscosity of the mixture, and/or decreases friction of the unfinished composite material during its handling in manufacture. Generally, within the art, there are two types of plasticizers that are suitable for use: (1) a primary plasticizer and (2) a secondary plasticizer or extender. A primary plasticizer improves the elongation and softness of a composition. Many examples of primary plasticizers are known in the art, all of which may be suitable for embodiments of the invention, and include, but are not limited to, vegetable oils such as castor oil, soybean oil, linseed oil or rapeseed oil, vulcanized vegetable oils, polyols, such as, but not limited to, ethylene glycol, glycerol, sorbitol, xylitol, erythritol, and other reduced sugars and derivatives thereof, urea and derivatives thereof, anhydro sugar and derivatives thereof, or any combination of the foregoing. A secondary plasticizer or extender enhances the compatibility and plasticizing effect of a primary plasticizer. A secondary plasticizer generally has low volatility and migration. Examples of secondary plasticizers, all of which may be suitable for embodiments of the invention, include, but are not limited to, polychlorinated linear alkanes (chlorinated paraffins), polyethylene glycol, polypropylene glycol, fatty acids such as stearic acid, oleic acid and the like, or any combination of the foregoing. Embodiments of the invention may comprise one or more of any of the aforementioned plasticizers in various amounts and ratios as further described in this disclosure.

Continuing with the method, in an embodiment, the mixture may comprise a one or more of the aforementioned plasticizer and in an amount in a range from about 8% (w/w) to about 25% (w/w), preferably in an amount in a range from about 8% (w/w) to about 20% (w/w), and most preferably in an amount in a range from about 8% (w/w) to about 15% (w/w).

Lubricating Agent. Continuing, the one or more lubricant or lubricating agent suitable for use in embodiments of the invention includes, but is not limited to, fatty acids, such as, but not limited to, for example, a one or more of stearic, palmitic, and myristic acids, derivatives and salts thereof, in particular, esters and calcium and barium salts thereof; hydrocarbons such as paraffin wax, low molecular weight polyethylene, silicon lubricants, and surfactants, and/or any combination thereof. Additionally, lubricants suitable for use in embodiments include, but are not limited to, wax ester derivatives, glyceryl esters, such as, but not limited to, a one or more of glyceryl monostearate, long-chain esters such as cetyl palmitate, soy wax, polyethylene glycol, fatty alcohol dicarboxylic acids, and surfactants, or any combination thereof. Any known external type of lubricant with a low compatibility with the polymer or composite is suitable for use. The choice of lubricant in any given situation will depend not only on the nature and characteristics of the composite material and the composition thereof, but also on the involved processing temperatures. All of the above mentioned lubricants are suitable for use in embodiments of the invention as the one or more lubricant or lubricating agent.

In an embodiment, the one or more lubricant added to the mixture may comprise an amount in a range from about 0.1% (w/w) to about 5% (w/w), more preferably in an amount in a range from about 0.6% (w/w) to about 3% (w/w), and most preferably in an amount in a range from about 1% (w/w) to about 2% (w/w).

Cross Linking Agents. The plant protein, separately or in combination with the plasticizer and/or the one or more non-proteinaceous polymer, may be crosslinked with a one or more crosslinking agent to modify the characteristic of the composite material. Crosslinking agents are well-known in the art and are used to covalently link two functional groups such as amino, carboxyl, sulfhydryl, or hydroxyl on the same polymer chain or different chains to each other through the formation of amide, ester, disulfide, carbamate linkages and thereby modify the properties of the protein or composition thereof. The one or more crosslinking agent is specific to and crosslinks the molecules comprising the one or more plant protein.

Continuing, the one or more cross-linking agent suitable for use in embodiments of the invention include, but are not limited to, carbonyldiimidazol and carbodiimide and dicyclohexylcarbodiimide. Other suitable as crosslinking agents for use in embodiments of the invention are another class of crosslinkers that are based on two or more reactive chemical groups such as active esters a-haloacyl compounds, aldehydes, and the like, connected with a spacer of different length. This class of crosslinking agents comprises both homo-bifunctional and heterobifunctional types. Examples of homo-bifunctional crosslinkers that may be suitable for use as crosslinking agents for embodiments include, but are not limited to, dialdehydes, such as, for example, glutaraldehyde, adipaldehyde and the like; diimidate esters of dicarboxylic acids, such as, for example, dimethyl pimelimidate, dimethyl suberimidate and the like; dicarboxylic acid esters of N-hydroxysuccinamide such as, for example, disuccinimidyl glutarate, disuccinimidyl suberate, bis(sulfosuccinimidyl)suberate, tris-(succinimidyl)aminotriacetate, and the like. Several sulfhydryl crosslinkers are also well-known in the art and may be suitable as crosslinking agents for embodiments of the invention. Examples of sulfhydryl crosslinkers include, but are not limited to, haloacetyl crosslinkers such as, for example, succinidyl iodoacetate, succinidyl 3-(bromoacetamido)propionate, succinimidyl (4-iodoacetyl)aminobenzoate, and the like; maleimide crosslinkers such as, for example, N-b-maleimidopropyl-oxysuccinimide ester, N-g-maleimidopropyl-oxysuccinimide ester, m-maleimidobenzoyl-N-hydroxsuccinimide ester, succinimidyl 4-((N-maleimidomethyl)cyclohexane-1-carboxylate and the like; and pyridyldithiol crosslinkers such as, for example, succinimidyl 3-(2-pyridyldithio)propionate, sulfosuccinimidyl 6-(3'-(2-pyridyldithio)propionamido)hexanoate, PEGylated, long chain succinimidyl 3-(2-pyridyldithio)propionate and the like. Many crosslinking agents or reagents are well-known in the art and commercially available in from venders such as SIGMA-ALDRICH™, THERMOFISHER SIENTIFIC™ and the like.

Also, commercially available and suitable for use as the one or more crosslinking agent suitable for use in embodiments of the invention are heterobifunctional crosslinkers which crosslink two different functional groups on the same polymer chain or two polymer chains. Examples of heterobifunctional groups which may serve as suitable crosslinking agents in embodiments of the invention include, but are not limited to, N-hydroxysuccinamide-haloacetyl, N-hydroxysuccinamide-maleimide, N-hydroxysuccinamide-pyridyldithiol, and the like (for linking amino and sulfhydryl groups); and dicyclohexylcarbodiimide and 1-ethyl-3-(3-dimethylaminopropyl)carbodiimide hydrochloride for linking carboxyl and amino groups; 3-maleimidopropionic acid hydrazide or succinimidyl 6-(3(2-pyridyldithio)-propionamido)hexanoate, and the like (for linking sulfhydryl and carboxyl groups).

Another class of crosslinking agents suitable for use in embodiments of the invention are photoreactive compounds which form nitrene or free radicals upon exposure UV/Vis light. Examples of photoreactive crosslinkers include, but are not limited to, succinimidyl 4,4'-azipentanoate, N-((2-pyridyldithio)ethyl)-4-azidosalicylamide, N-5-Azido-2-nitrobenzyloxysuccinimide, N-5-Azido-2-nitrobenzyloxysuccinimide and the like.

Another useful reagent suitable for use as the one or more crosslinking agent for embodiments of the invention is cyanogen bromide. Cyanogen bromide is particularly useful in activating polysaccharides polymers for crosslinking to other polymers such as polysaccharides, proteins, or any other polymer comprising a free hydroxyl or amino group by forming isourea or imidocarbonate linkages.

Embodiments of the invention may comprise one or more of any of the aforementioned crosslinkers or crosslinking agents. All of the above mentioned crosslinking agents may be suitable for use in embodiments of the invention.

In yet another embodiment, the one or more non-proteinaceous polymer comprises a chemical functionality that may be utilized as a crosslinker. Examples of such a non-proteinaceous include, but are not limited to, polycarbodiimide.

In an embodiment, the one or more crosslinking agent may be either added to the plant protein alone (prior to mixing with the composition mixture) or to the mixture comprising a one or more plant protein powder, a one or more plasticizer and/or one or more non-proteinaceous polymer in an amount in a range from about 1% (w/w) to about 5% (w/w) based on the weight of the protein content of the one or more plant protein powder (i.e., crosslinking agent/plant protein ratio) based on the specific one more plant protein used, preferably in an amount in a range from about 1.5% (w/w) to about 5% (w/w), more preferably in an amount in a range from about 2% (w/w) to about 3% (w/w).

Blowing Agent. In embodiments, the mixture may comprise a blowing agent, also known as pneumatogen(s), in an amount in a range from about 0.5% (w/w) to about 2% (w/w). A blowing agent is a substance which is capable of producing a cellular structure via a foaming process in a variety of materials that undergo hardening or phase transition, such as polymers, plastics, and metals. Examples of blowing agents suitable for use in embodiments of the invention include, but are not limited to, physical blowing agents, such as, for example, pentane, isopentane, cyclopentane and the like; chemical blowing agents such as, for example, isocyanate and water, azidodicarbonamide, sodium bicarbonate, and the like; and porous particles such as, for example, fly ash, vermiculite, and hollow spheres. In an embodiment, the blowing agent may be hollow spheres such as, for example, Nouryon EXPANCEL® microspheres. Embodiments of the invention may comprise one or more of any of the aforementioned blowing agents, all of which may be suitable for embodiments of the invention.

Curing Agent. In embodiments, the one or more curing agent comprises one or more vulcanization agents in an amount in a range of 1% to 10% (w/w) based on weight of the one or more non-proteinaceous polymer (i.e., curing agent/polymer ratio), based on the specific one more non-proteinaceous polymer used, preferably in an amount in a range from about 2% (w/w) to about 8% (w/w), more preferably in an amount in a range from about 3% (w/w) to about 6% (w/w). The vulcanization agent may comprise a one or more of a peroxide curing agent, a sulfur-based curing agent, disulfiram (tetraethylthiuram disulfide or TETD), mercaptobenzothiazole disulfide (MBTS), sulfur, or any combination thereof. As discussed further within this disclosure, the one or more curing agent is generally added last in the mixing stage, prior to calendaring the mixture.

Surfactant. In embodiments, the mixture may comprise a one or more neutral, cationic and/or anionic surfactant in an amount in a range from about 0.5% (w/w) to about 15% (w/w), preferably in an amount in a range from about 3% (w/w) to about 8% (w/w), more preferably in an amount in a range from about 4% (w/w) to about 6% (w/w), and most preferably in an amount of about 5% (w/w) of the weight of the protein.

Pigment/Dye/Coloring Agent. In embodiments, the mixture may comprise a one or more coloring agent and/or pigment. The amount and the type of coloring agent may vary depending on the desired color and its intensity. In an embodiment, the mixture and resulting composition may comprise more than one coloring agent to achieve a desired color. As used herein, the term "pigment" refers to colored insoluble material used as a suspension of finely grounded solid particles blended with other materials and it may be organic or inorganic. In addition, a coloring agent may comprise a "dye," a colored substance that chemically bonds to the substrate to which it is applied. Any number of dyes, pigments, and/or combinations thereof may be incorporated into the imitation leather composite material to achieve a desired color. Examples of dyes include, but are not limited to, aniline dyes, such as, for example, mauveine, fuchsin, safranin, induline, and the like; indole dyes such as, for example, indigo blue, indigo red, and the like; and acridine dyes, such as, for example, acridine orange, acridine yellow, acriflavine, gel green, and the like. Examples of pigments include, but are not limited to, cadmium pigments, such as, for example, cadmium yellow, cadmium red, cadmium green, cadmium orange, cadmium sulfoselenide; cobalt pigments, such as, for example, cobalt violet, cobalt blue, cerulean blue, aureolin, and the like; copper pigments, such as, for example, Azurite, Han purple, Han blue, Egyptian blue, Malachite, Paris green and the like; iron oxide pigments, such as, for example, sanguine, caput mortuum, oxide red, red ochre, yellow ochre, and the like; lead pigments, such as, for example, lead white, Cremnitz white, Naples yellow, and the like; manganese pigments, such as, for example, manganese violet and the like; titanium pigments, such as, for example, titanium yellow, titanium white, titanium black, and the like; mercury pigments, such as, for example, vermilion and the like; zinc pigments, such as, for example, zinc white, zinc ferrite, zinc yellow and the like; aluminum powder pigments; carbon pigments, such as, for example, carbon black, ivory black, and the like; and sulfur based Ultramarine pigments. Also suitable for use in embodiments of the invention are organic pigments, such as, for example, alizarine, gamboge, cochineal red, rose madder, indigo, Indian yellow, quinacridone, magenta, pthalo green, pthalo blue, and the like. In an embodiment, the mixture comprises one or more dye and/or a pigment in an amount in a range from about 0.5% (w/w) to about 5.0% (w/w).

Embodiments of the invention may comprise one or more of any of the aforementioned dyes, pigments, and coloring agents, all of which may be suitable for embodiments of the invention. In embodiments, the one or more of any of the aforementioned dyes, pigments, and coloring agents may be applied to a surface of the leather material by application of a finishing agent, wherein the one or more dye, pigment, or coloring agent is an ingredient or additive of the finishing agent or material.

Filler. In embodiments, the mixture may comprise a one or more filler. Imitation leather composite material comprising a one or more filler may be made breathable by stretching, which causes the protein/polymer to break away from the filler and create microporous passageways. Techniques for forming microporous fabric and films are generally known in the art and may be used for various embodiments of the invention as described herein. The filler may comprise particles having a desired size, such as those having an average size in a range from about 0.5 micrometers to about 10 micrometers. Suitable particles for use as a filler in embodiments of the invention may include, but are not limited to, inorganic oxides, such as, for example, calcium carbonate, calcium oxide, kaolin clay, silica, alumina, barium carbonate, sodium carbonate, silica, fumed silica, titanium dioxide, zeolites, magnesium carbonate, magnesium oxide, aluminum hydroxide, talc, sulfate salts, dixie clay, or any combination thereof. Other suitable particles are generally known and understood in the art and may be used in fillers for various embodiments described herein.

In an embodiment, the one or more filler comprises an amount of up to and including 15% (w/w) of an inorganic filler material such as, for example, silica, fumed silica, powdered calcium carbonate, dixie clay, or any combination thereof.

Embodiments of the invention may comprise one or more of any of the aforementioned fillers, each of which may be suitable for embodiments of the invention.

In embodiments, the mixture may comprise filler content in an amount in a range from about 2% (w/w) to about 15% (w/w), preferably in an amount in a range from about 5% (w/w) to about 15% (w/w), preferably in an amount in a range from about 10% (w/w) to about 15% (w/w).

Fire Retardant Agent. In embodiments, the mixture may further comprise a one or more fire retardant agent. Several types of fire retardant are generally known that may be suitable for use in embodiments of the invention, and include, but are not limited to, various minerals, such as, for example, aluminum hydroxide, magnesium hydroxide, red phosphorus, and borate salts, and the like; organohalogen compounds, such as, for example, chloendic acid derivatives, chlorinated paraffin, decabromodiphenyl ether, decabromodiphenylethane, brominated polystyrene, brominated carbonate oligomers, brominated epoxy oligomers, tetrabromophthalic anhydride, tetrabrombisphenol A, hexabromocyclododecane; organophosphorus compounds, such as, for example, triphenylphosphate, resorcinol bis diphenyl phosphate, bisphenol A diphenyl phosphate, tricresyl phosphate, and phosphonates such, for example, dimethyl methylphosphonate, aluminum diethylphosphonate; and other organic compounds such as, for example, melamine, carboxylic acid, dicarboxylic acid and the like, or any combination of any of the foregoing. Some but not all halogenated flame retardants may be used in conjunction with inorganic antimony compounds such as antimony trioxide, antimony pentaoxide, and sodium antimonate to enhance their efficiencies.

Embodiments of the invention may comprise one or more of any of the aforementioned flame retardants, each of which may be suitable for embodiments of the invention.

In embodiments, the fire retardant may be incorporated into the non-proteinaceous polymer during the polymerization process or within the plant protein and plasticizer portions during the mixing phase, in each case in an amount in a range from about 1% (w/w) to about 25% (w/w), preferably in an amount in a range from about 5% (w/w) to about 15% (w/w), more preferably in an amount in a range from about 8% (w/w) to about 12% (w/w), and most in an amount preferably about 10% (w/w).

Finishing Agent/Material. Embodiments of the method of creating the monolayer imitation leather composite material (and the leather material composition created thereby) may comprise the additional step of applying a coating of a one or more finishing material or agent to a surface of the monolayer leather material, wherein the one or more finishing material may be comprised of polyurethane, polyurethane-polyester, acrylic resin, a cellulose ester (such as cellulose acetate, cellulose propionate, and/or cellulose butyrate), or any combination thereof. The finishing agent or material may be pigmented to add color to the imitation leather. Other useful finishing materials are tree saps. Embodiments of the invention may comprise one or more of any of the aforementioned surface coatings, each of which may be suitable for embodiments of the invention. In an embodiment, the coating of the finish material is comprised of a thickness in a range from about 5 um to 50 um.

Fabric Backing. In various embodiments, the monolayer imitation leather material is pressed onto a backing fabric or substrate. The backing fabric or substrate is ideally an organic plant-based biodegradable fabric. The backing fabric or substrate is moved through the rollers of the calendar as the mixture is applied or affixed onto the fabric or substrate. Suitable backing fabric may comprise 100% cotton woven or interlock fabrics, Tencel® woven or interlocks, or other natural plant-based fabrics such as linen, bamboo/Tencel blend fabrics, hemp or hemp/cotton blend fabrics, or any other suitable backing as may be generally known in the art.

Embossing. In an embodiment, prior to or after the curing step, the flat sheet of composite material may be embossed with various animal based patterns such as bovine, goat, alligator, crocodile, and/or reptile skin patterns. In such embodiments, the flat sheet of composite material is moved via the conveyor to a printing or embossing station wherein one or more imprinting rollers or stamping means may imprint shapes or patterns onto the flat sheet of composite material.

Finishing Agent/Material. Embodiments of the method of creating the monolayer imitation leather composite material (and the leather material composition created thereby) may comprise the additional step of applying a coating of a one or more finishing material or agent to a surface of the monolayer leather material, wherein the one or more finishing material may be comprised of polyurethane, polyurethane-polyester, acrylic resin, a cellulose ester (such as cellulose acetate, cellulose propionate, and/or cellulose butyrate), or any combination thereof. The finishing agent or material may be pigmented to add color to the imitation leather. Other useful finishing materials are tree saps. Embodiments of the invention may comprise one or more of any of the aforementioned surface coatings, each of which may be suitable for embodiments of the invention. In an embodiment, the coating of the finish material is comprised of a thickness in a range from about 5 um to 50 um.

Curing. After calendaring, in various embodiments the flat sheet of composite material may be cured in a temperature range from about 100° C. to about 160° C. under pressure in a range from about 0.3 Mpa to 10 Mpa pressure for a period of time in a range from about 30 minutes to about 60 minutes to form the monolayer imitation leather with a calendered thickness in a range from about 0.5 mm to about 5 mm. In an embodiment, the flat sheet of composite material may be moved via a conveyor or other rollers through an oven or other heating device to apply heat and/or pressure for a predetermined period of time. The thickness of the imitation leather material is determined and created by adjustment of the calendering process machinery as desired by a user.

The steps of various process embodiments may be performed in no specific order. In an embodiment, the addition of the curing agent to the mixture is performed last and prior to calendaring.

In embodiments, mixing is conducted utilizing a suitably sized mixing vessel depending on the amount of ingredients to be mixed as desired by a user. In embodiments, mixing of the ingredients is conducted at a temperature in a range from about 60° C. to about 120° C. and more preferably in a range from about 90° C. to about 120° C. Generally, heat is generated during the mixing process due to friction of the ingredients, but heat may be applied as necessary from an external heat source to achieve the range of temperatures. The mixing heat should be maintained through the mixing process, until the ingredients are well mixed, homogenous in nature, and the mixture is ready for calendaring.

Calendaring the mixture generally doesn't require the use of solvents. Calendaring is conducted at a heated roll temperature, as described further within this disclosure, the techniques of which are generally well known in the art.

FIG. 1 depicts method 100 of an embodiment of the invention. Step 120 comprises a mixing phase, wherein a mixture is obtained by combining and mixing a one or more plant protein powder, a one or more non-proteinaceous polymer, a one or more plasticizer, a one or more crosslinker or crosslinking agent, and a one or more curing agent, all in various amounts, combinations, and ratios. Step 140 comprises a calendering phase, wherein the mixture obtained at step 120 is calendered into a flat monolayer sheet, wherein the calendering is conducted at a controlled heated roll temperature from 35° C. to 90° C., the calendered monolayer sheet is applied or affixed to a surface of a carrier fabric, and the calendered monolayer sheet is of a desired thickness. Step 160 comprises a curing phase, wherein the calendered monolayer sheet obtained at step 140 is heated at a temperature range, under a specified pressure and for a period of time. The process is complete at step 180 and the monolayer imitation leather material is ready.

In an embodiment of method 100 of FIG. 1, step 120 comprises obtaining a mixture by combining and mixing together a one or more plant protein powder in an amount of at least 70% (w/w), wherein the protein content of the one or more plant protein powder comprises an amount in a range from about 28% (w/w) to about 65% (w/w), and wherein the plant protein comprises wheat gluten, brown rice protein, barley protein, maize protein, or any combination thereof, a one or more non-proteinaceous polymer or toughening elastomer in an amount in a range from about 25% (w/w) to 50% (w/w), a one or more plasticizer in an amount in a range from about 8% (w/w) to about 25% (w/w), a one or more cross-linking agent in an amount in a range of about 1% (w/w) to about 5% (w/w based on the weight of the protein content of the one or more plant protein powder), and a one or more curing agent in an amount in a range from about 1% (w/w) to about 10% (w/w based on the weight of the one or more non-proteinaceous polymer); step 140 comprises calendering the mixture into a flat, monolayer sheet, wherein the calendering is conducted at a controlled roll temperature from 35° C. to 90° C., wherein the calendered monolayer sheet is applied to or affixed onto a surface of a carrier fabric and wherein the monolayer sheet comprises a thickness in a range from about 0.5 to 5 mm; and step 160 comprises curing the calendered monolayer sheet by applying heat at a temperature in a range from about 100° C. to about 160° C., at pressure in a range from about 0.3 Mpa to 5 Mpa pressure, and for a period of time in a range from about 10 minutes to about 60 minutes. In an embodiment, method 100 may produce or create an imitation leather material having a thickness in a range from about 0.5 mm to about 5.0 mm, a tensile strength in a range of about 1.0 Mpa to about 15 Mpa, and an elongation at break in a range of about 20% to about 200%, a tear resistance in a range from about 100 psi to 500 psi, and a Bally flex resistance in range from about 20,000 cycles to about 200,000 cycles. It is to be understood that other embodiments of the method as disclosed in this disclosure may also be graphically depicted in FIG. 1.

Figure 2:
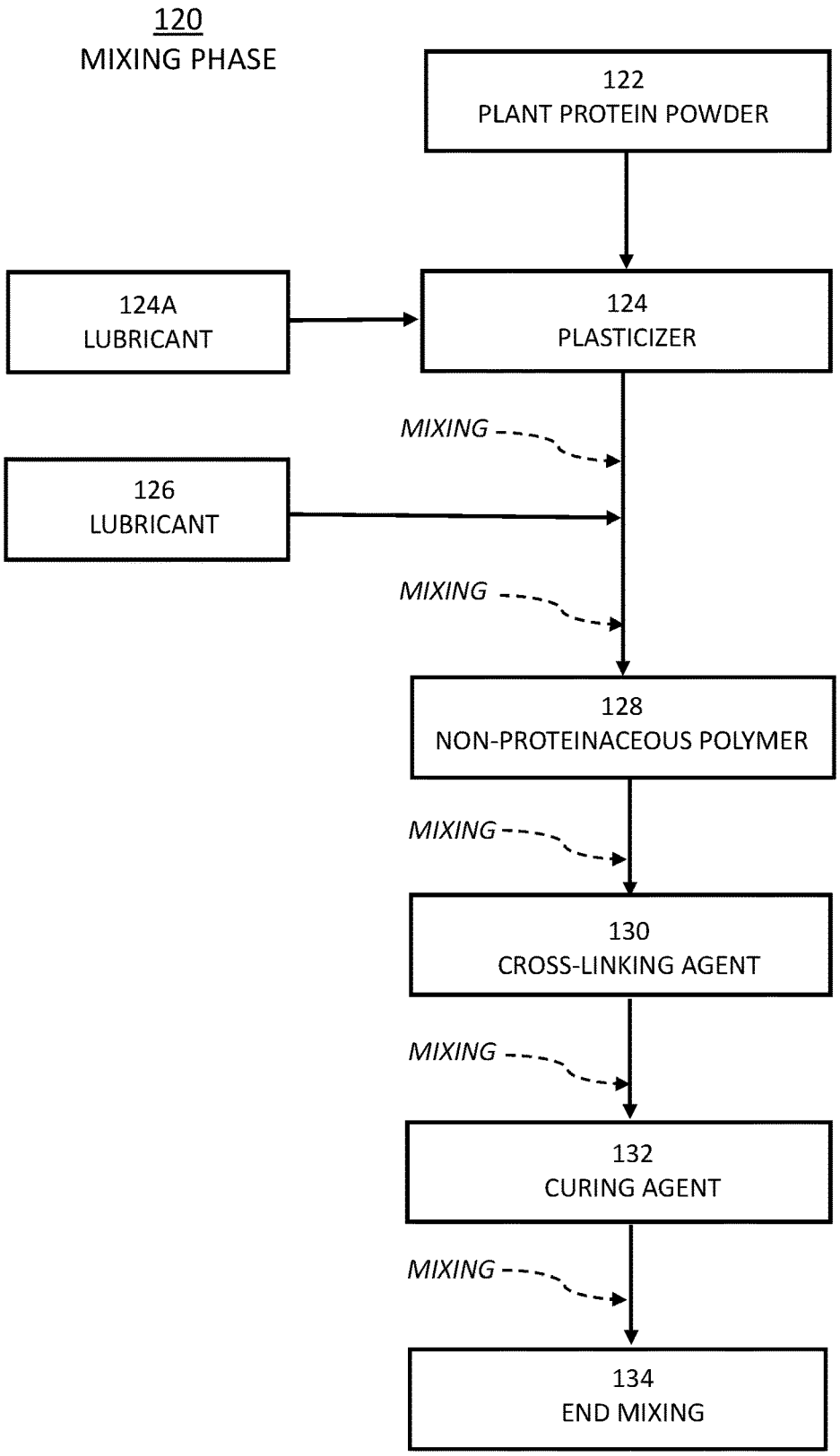
FIG. 2 depicts a mixing phase 120 embodiment of various embodiments of method 100 in greater detail.

FIG. 2 depicts an embodiment of mixing phase 120 of various embodiments of method 100 in greater detail. At step 122, a one or more plant protein powder is added to a mixing vessel appropriate for use in mixing compositions of similar nature and well known in the art. At step 124, a one or more plasticizer is added to the one or more plant protein powder in the mixing vessel and mixed at a controlled heat temperature as previously discussed in an appropriately sized mixing vessel with sufficient strength and power suitable for mixing such ingredients generally at a mixing rate of about 20 to 30 rpm in an internal mixer. In embodiments, at step 124A a one or more lubricating agent may also be added to the mixture simultaneously with the one or more plasticizer. In an embodiment, the one or more lubricating agent may be added subsequently at step 126. At step 128, a one or more non-proteinaceous polymer is added to the mixture in the mixing vessel and mixing of the composition continues. At step 130, a one or more cross-linking agent is added to the mixture in the mixing vessel and mixing of the composition continues until the composition is thoroughly mixed. At step 132, a one or more curing agent is added to the mixture in the mixing vessel and mixing of the composition continues until the composition is thoroughly mixed. At step 134, mixing is complete and the mixture is ready for calendering at calendering phase 140.

Continuing with FIG. 2, in embodiments, step 122 comprises the addition of a one or more plant protein powder in an amount of at least 70% (w/w), wherein the protein content of the one or more plant protein powder comprises an amount in a range from about 28% (w/w) to about 65% (w/w), and wherein the plant protein comprises wheat gluten, brown rice protein, barley protein, maize protein, or any combination thereof; step 124 comprises the addition and mixing together of a one or more plasticizer in an amount in a range from about 8% (w/w) to about 25% (w/w); step 128 comprises the addition and mixing together of a one or more non-proteinaceous polymer in an amount in a range from about 25% (w/w) to 50% (w/w); step 130 comprises the addition and mixing together of a one or more cross-linking agent in an amount in a range of about 1% (w/w) to about 5% (w/w) (based on the weight of the protein content of the one or more plant protein powder); and step 132 comprises the addition and mixing together a one or more curing agent in an amount in a range from about 1% (w/w) to about 10% (w/w) (based on the weight of the one or more non-proteinaceous polymer). In embodiments, at step 124, a a one or more lubrication agent or lubricant may be combined to the mixture 124A, wherein a combined amount of the lubricating agent and the one or more plasticizer is in a range from about 8% (w/w) to about 25% (w/w). Alternatively, in embodiments, step 126 may comprise the addition and mixing together of a one or more lubrication agent or lubricant, wherein a combined amount of the lubricating agent and the one or more plasticizer from step 124 is in a range from about 8% (w/w) to about 25% (w/w). Lastly, in an embodiment a one or more lubricant may be added to the mixture at both steps 124A and 126. It is to be understood that all embodiments of the method as disclosed in this disclosure may be graphically represented in FIG. 2.

Figure 3:
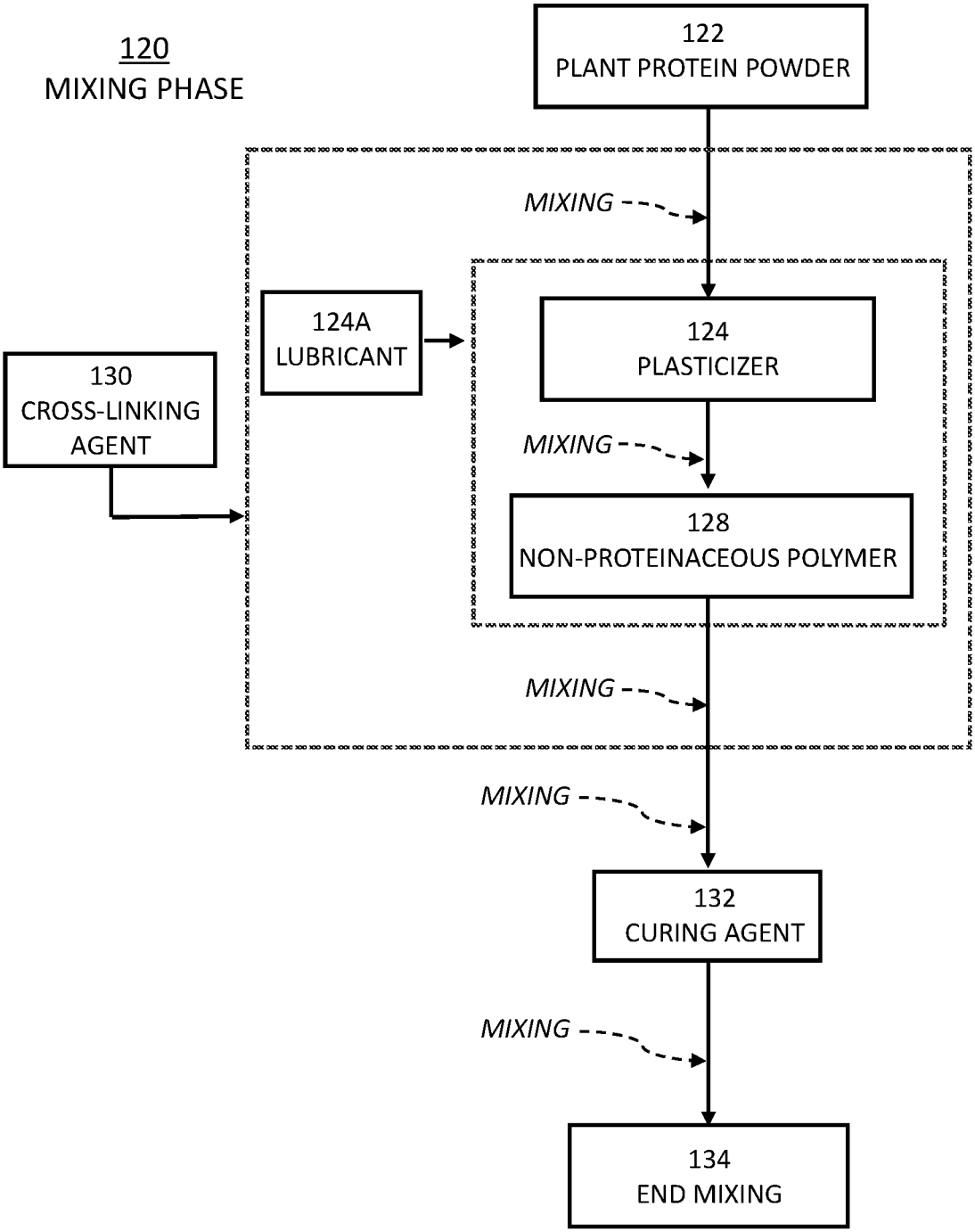
FIG. 3 depicts another embodiment of mixing phase 120 of various embodiments of method 100 in greater detail.

FIG. 3 depicts an embodiment of mixing phase 120 of various embodiments of method 100 in greater detail. Similar to FIG. 2, at step 122, a one or more plant protein powder is added to an appropriate mixing vessel, and at step 124, a one or more plasticizer is added to the one or more plant protein powder in the mixing vessel and mixed at a controlled heat temperature as previously discussed. The one or more lubricating agent may be added to the mixture 124A at any time commencing from prior to the addition of the one or more plasticizer 124 until after the addition of the one or more non-proteinaceous polymer at step 128. Mixing continues during the process at the controlled temperature. Continuing, a one or more cross-linking agent may be added to the mixture 130 at any time commencing from prior to the addition of the one or more lubricating agent 124A and/or plasticizer 124 until prior to the addition of a one or more curing agent 132. Mixing is maintained throughout the process until after addition of one or more curing agent 132 and thorough mixing is complete 134. the mixture is ready for calendering at calendering phase 140. It is to be understood that all embodiments of the method as disclosed in this disclosure may be graphically represented and incorporated within FIG. 3.

Figure 4:
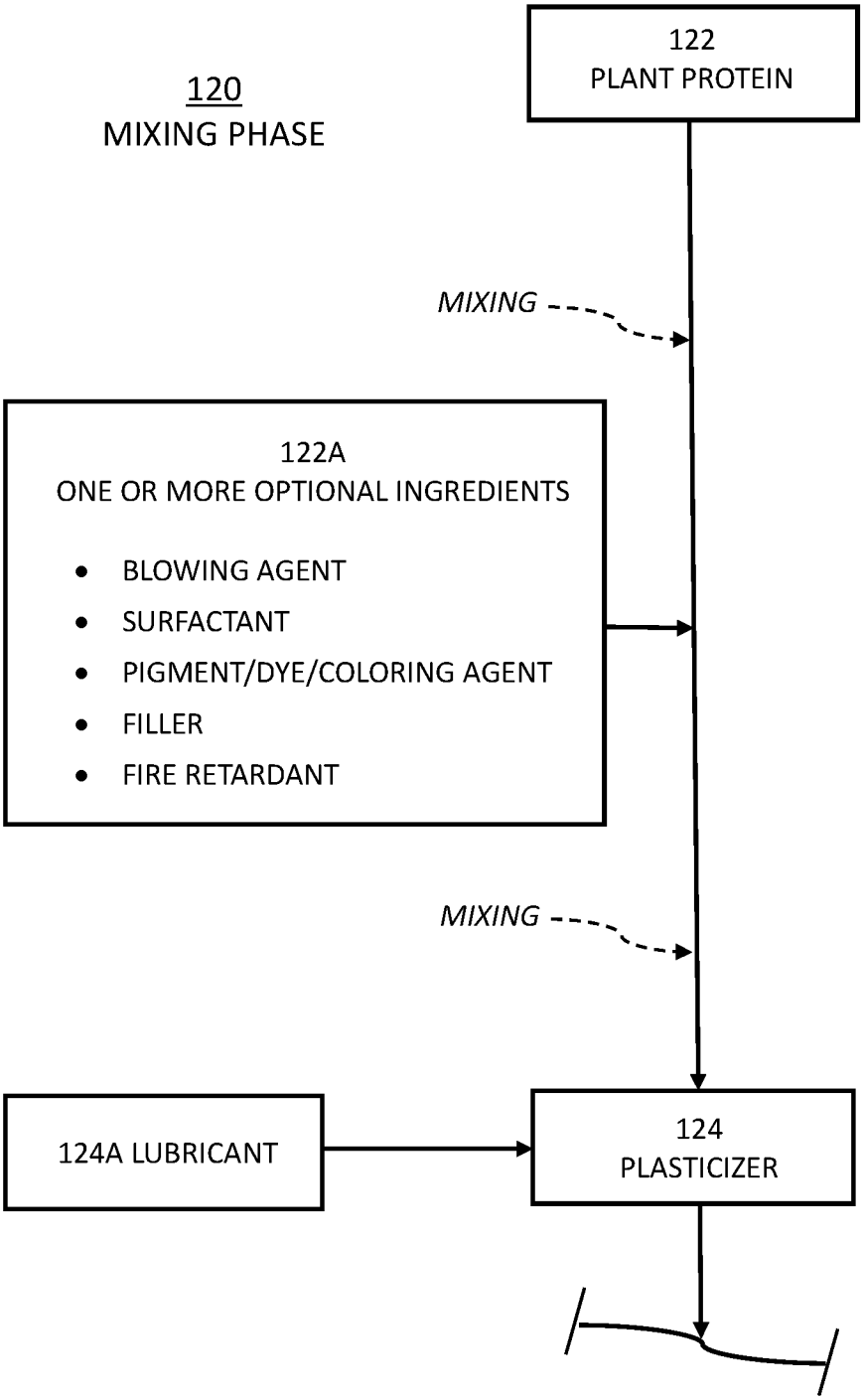
FIG. 4 depicts various optional steps which may be implemented in or during an embodiment of mixing phase 120 of various embodiments of method 100.

FIG. 4 depicts various optional steps comprising mixing phase 120 of method 100 wherein various optional ingredients may be combined to and mixed within the mixture for mixing. At step 122A, one or more of the following may be added to the mixture in various embodiments of the invention: a one or more blowing agent, a one or more vulcanization agent, a one or more surfactant, a one or more pigment, dye or coloring agent, a one or more filler, a one or more fire retardant, or any combination of the foregoing. It is to be understood that all embodiments of the method as disclosed in this disclosure may be graphically represented and incorporated within FIG. 3, including all embodiments depicted in the drawings, and the embodiment of FIG. 4 may be included and graphically represented and incorporated within all other drawings.

Figure 5A:
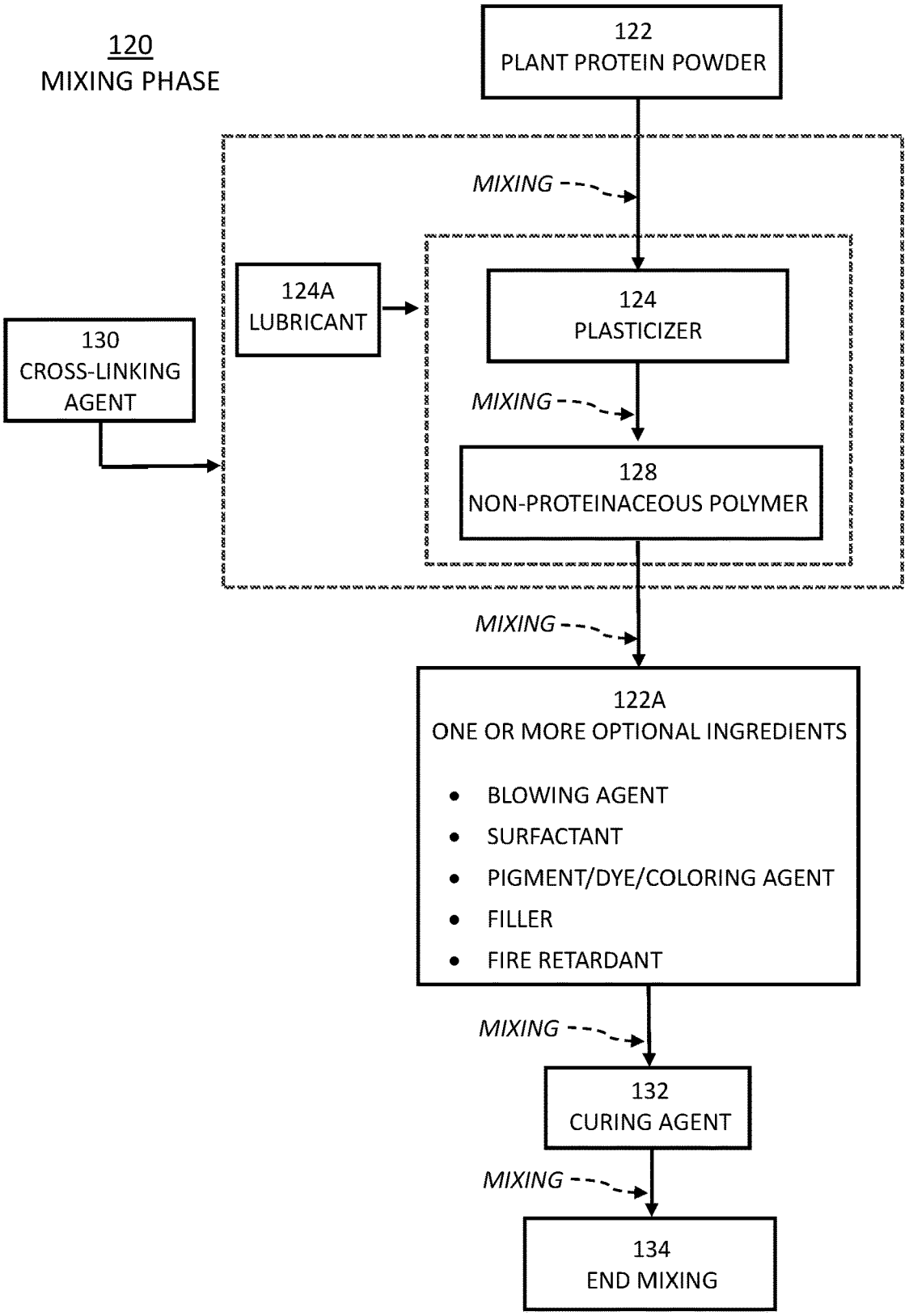
FIG. 5A depicts an embodiment of mixing phase 120 of various embodiments of method 100 comprising various optional steps which may be implemented.

FIG. 5A depicts an embodiment of mixing phase 120 of various embodiments of method 100 in greater detail. Similar to FIGS. 2-4, at step 122, a one or more plant protein powder is added to an appropriate mixing vessel, and at step 124, a one or more plasticizer is added to the one or more plant protein powder in the mixing vessel and mixed at a controlled heat temperature as previously discussed. The one or more lubricating agent may be added to the mixture 124A at any time commencing from prior to the addition of the one or more plasticizer 124 until after the addition of the one or more non-proteinaceous polymer at step 128. Mixing continues during the process at the controlled temperature. Continuing, at step 122A, one or more of the following optional ingredients may be added to the mixture in various embodiments of the invention: a one or more blowing agent, a one or more vulcanization agent, a one or more surfactant, a one or more pigment, dye or coloring agent, a one or more filler, a one or more fire retardant, or any combination of the foregoing. In the embodiment of FIG. 5A, the one or more optional ingredients are added to the mixture immediately prior to the addition of a one or more curing agent 132 and after all other ingredients have been added to the mixture. In the embodiment of FIG. 5A, a one or more cross-linking agent may be added to the mixture 130 at any time commencing from prior to the addition of the one or more lubricating agent 124A and/or plasticizer 124 until prior to the addition of the one or more optional ingredients 122A. Mixing is maintained throughout the process until after addition of one or more curing agent 132 and thorough mixing is complete 134 and the mixture is ready for calendering at calendering phase 140. It is to be understood that all embodiments of the method as disclosed in this disclosure may be graphically represented in FIG. 5A.

Figure 5B:
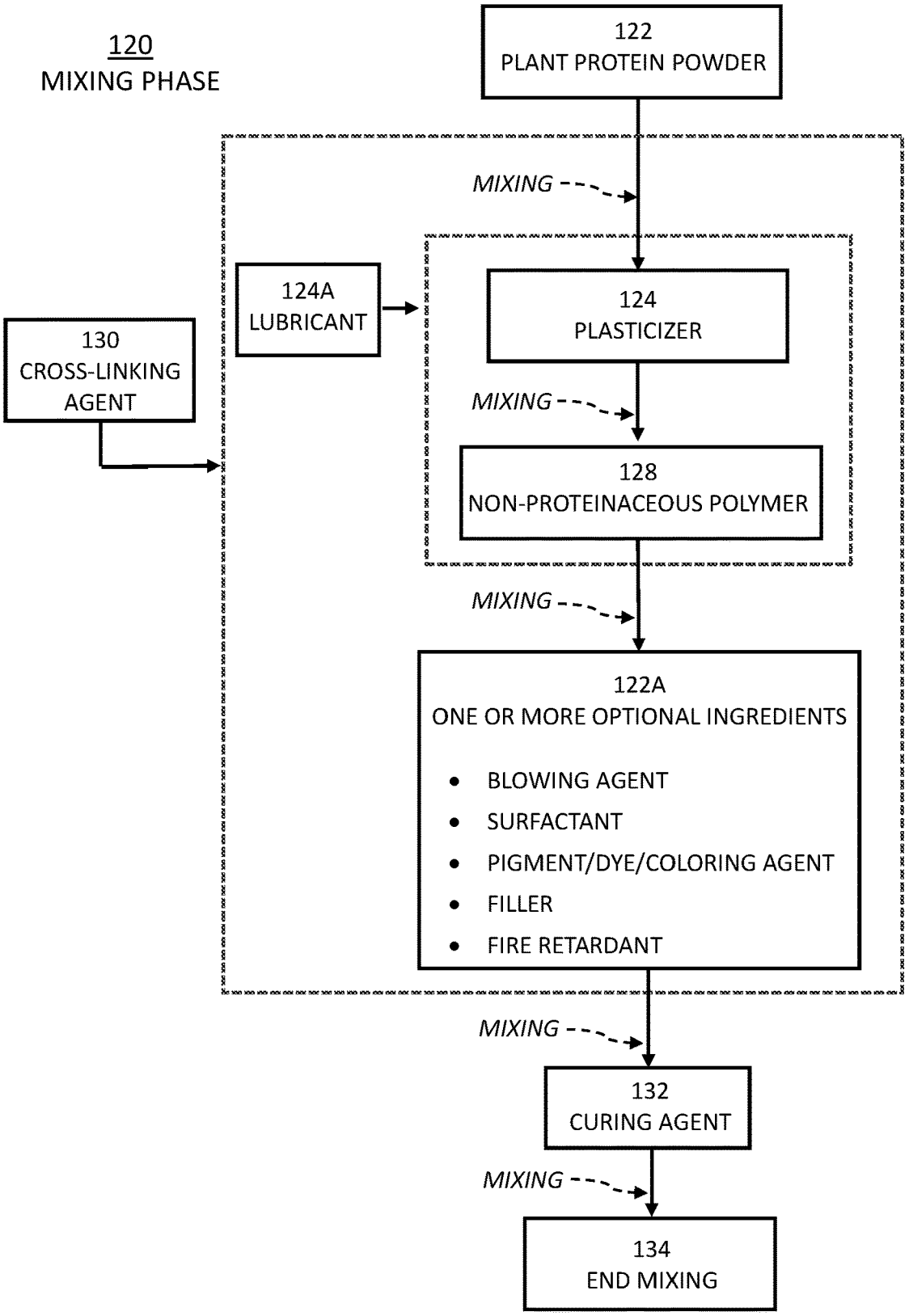
FIG. 5B depicts an embodiment of mixing phase 120 of various embodiments of method 100 comprising various optional steps which may be implemented.

FIG. 5B depicts an embodiment of mixing phase 120 of various embodiments of method 100 in greater detail. Similar to FIGS. 2-4, at step 122, a one or more plant protein powder is added to an appropriate mixing vessel, and at step 124, a one or more plasticizer is added to the one or more plant protein powder in the mixing vessel and mixed at a controlled heat temperature as previously discussed. The one or more lubricating agent may be added to the mixture 124A at any time commencing from prior to the addition of the one or more plasticizer 124 until after the addition of the one or more non-proteinaceous polymer at step 128. Mixing continues during the process at the controlled temperature. Continuing with FIG. 5B, at step 122A, one or more of the following optional ingredients may be added to the mixture in various embodiments of the invention: a one or more blowing agent, a one or more vulcanization agent, a one or more surfactant, a one or more pigment, dye or coloring agent, a one or more filler, a one or more fire retardant, or any combination of the foregoing. In the embodiment of FIG. 5A, the one or more optional ingredients are added to the mixture subsequent to the addition of the one or more non-proteinaceous polymer at step 128 and prior to the addition of a one or more curing agent 132. Unlike the embodiment of FIG. 5A, in the embodiment of FIG. 5B, a one or more cross-linking agent may be added to the mixture 130 at any time commencing from prior to the addition of the one or more lubricating agent 124A and/or plasticizer 124 until after the addition of the one or more optional ingredients 122A and immediately prior to the addition of a one or more curing agent 132. Mixing is maintained throughout the process until after addition of one or more curing agent 132 and thorough mixing is complete 134 and the mixture is ready for calendering at calendering phase 140. It is to be understood that all embodiments of the method as disclosed in this disclosure may be graphically represented in FIG. 5B.

Figure 6:
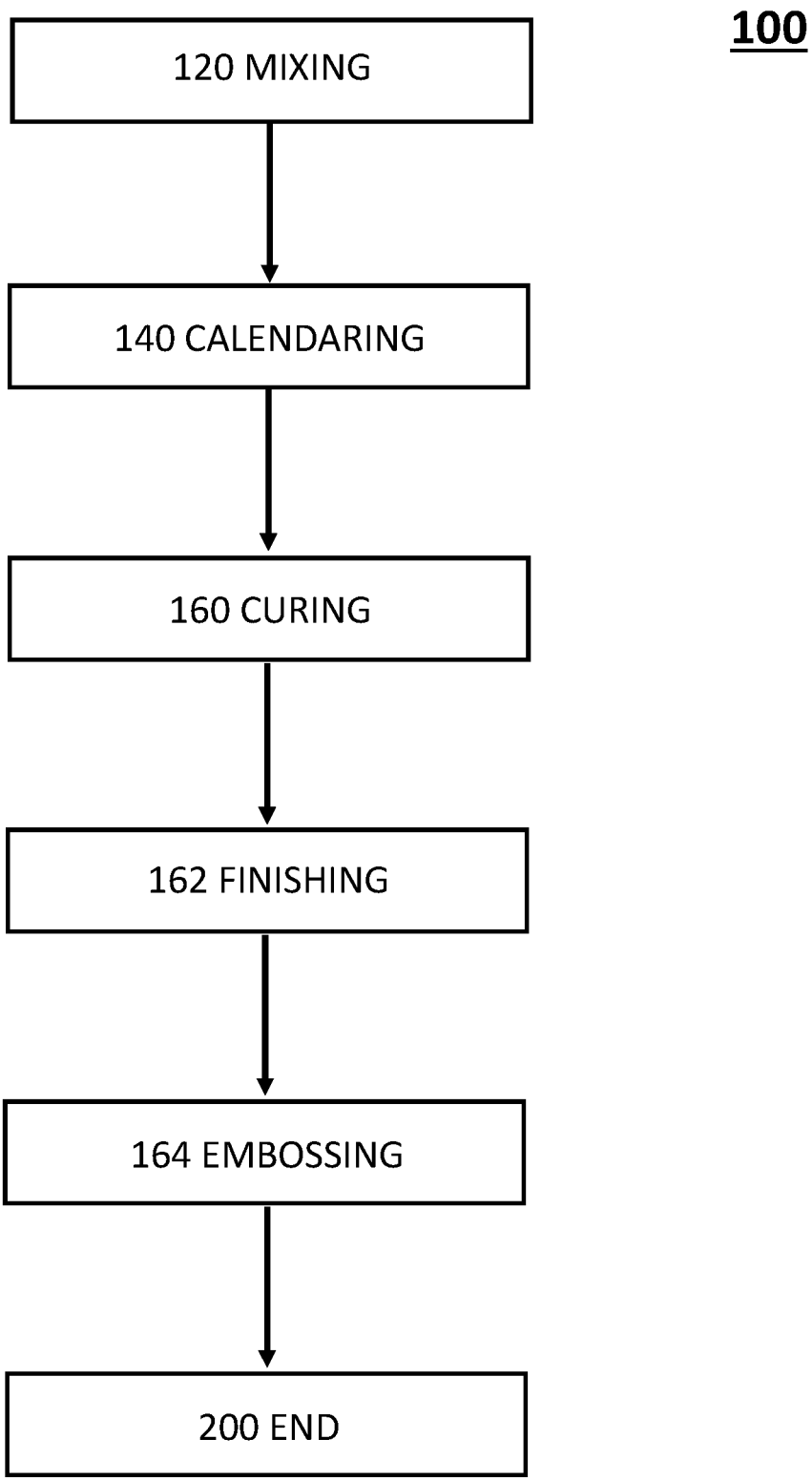
FIG. 6 depicts method 100 of an embodiment of the invention.

FIG. 6 depicts method 100 of an embodiment of the invention disclosing additional steps subsequent to curing step 160. In particular, after curing at step 160, the cured composition material, according to the various embodiments set forth in this disclosure, may undergoing a finishing step 162 wherein a finishing agent or material is applied to a surface of the cured composition leather material in accordance with the processes previously described. Following finishing 162, the composition leather may further undergo an embossing step 164 as previously described herein. At step 200, the monolayer leather material is complete and ready for use.

Figure 7:
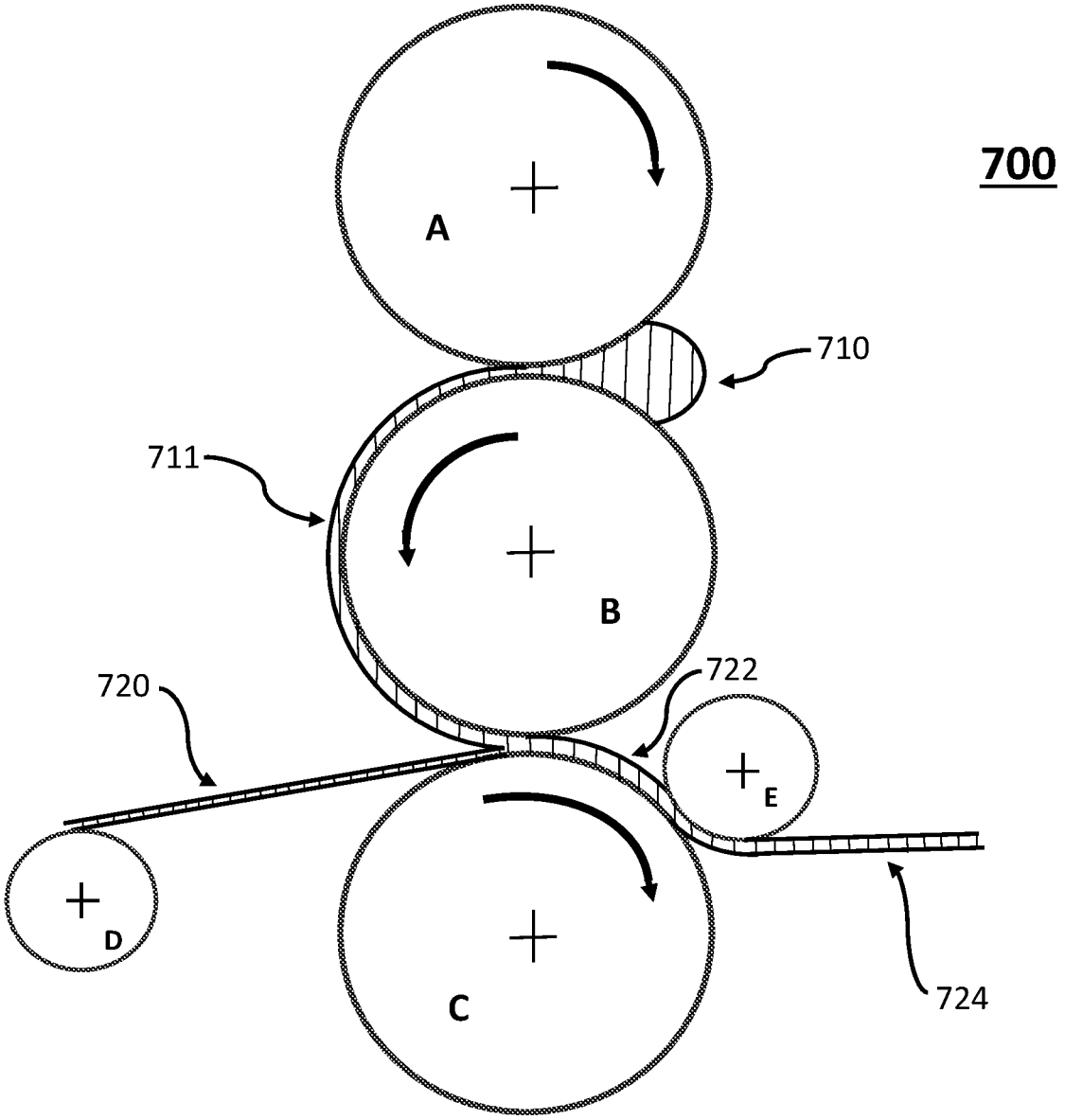
FIG. 7 depicts a cross section view of a possible calendering processing system.

FIG. 7 depicts a cross section view of a possible calendering processing system 700. A headstock 710 of a completed and fully mixed composition in accordance with embodiments of the invention as detailed herein is fed through rotating roller A and counter-rotating roller B. The cross section of roller A, as depicted in system 700 is rotating in a clockwise manner, while the cross section of roller B is rotating in a counterclockwise direction, as depicted by the arrows on roller A and roller B. The mixture composition 710 is compressed between rollers A and B to a desired thickness. After being compressed between rollers A and B, the flat sheet composition 711 wraps around roller B and continues in the counterclockwise direction. As the flat sheet 711 enters the space between roller B and roller C, it is combined, affixed, or attached to a backing fabric 720 in accordance with embodiments of the invention as detailed herein. In the calendering system 700 of FIG. 7, the cross section view of roller C is counter-rotating to the cross section view of roller B. In this case, the cross section of roller C is rotating in a clockwise direction. Because roller B and roller C are counter-rotating about their respective axes (the axis of each roller depicted by a "+" symbol), flat sheet 711 is compressed onto the carrier or backing fabric 720 to a desired thickness. The combined composition/fabric material 722 continues about roller C in a clockwise fashion. The carrier/backing fabric having been previously feed around roller E prior to calendering, the compressed composition/fabric material 722 continues around roller E (the cross section of which is rotating in a counterclockwise fashion) to provide a final finish. The finished material 724 is then directed in a desired direction for curing. The calendering system 700 of FIG. 7 is merely an example of a possible means of calendering the composition mixture 710 into a flat sheet and affixing it to a fabric backing. Those skilled in the art would readily appreciate and understand many other suitable methods and means of carrying out this process and FIG. 7 should not be considered as limiting the nature and scope of any of embodiment of the invention.

While the various steps in the flowcharts in FIGS. 1-6 are presented and described sequentially, one of ordinary skill would readily appreciate that some or all of the steps may be executed in different orders and some or all of the steps may be executed in parallel. Further, in one or more embodiments of the invention, one or more of the steps described below may be omitted, repeated, and/or performed in a different order. Accordingly, the specific arrangement of steps shown in FIGS. 1-6 should not be construed as limiting the scope of the invention.

The process parameters and sequence of steps described and/or illustrated herein are given by way of example only. For example, while the steps illustrated and/or described herein may be shown or discussed in a particular order, these steps do not necessarily need to be performed in the order illustrated or discussed. Some of the steps may be performed simultaneously. In addition, the various example methods described and/or illustrated herein may also omit one or more of the steps described or illustrated herein or include additional steps in addition to those disclosed.

In an embodiment, the mixture may be obtained by preparing a suspension of a composition comprising a one or more plant protein powder, a one or more plasticizer (which may include a one or more lubricating agent), a one or more crosslinking agent, a one or more non-proteinaceous polymers, and any other desired ingredients, including, but not limited to, a blowing agent, a filler, a fire retardant, a dye and/or pigments, all in an aqueous organic solvent. The aqueous organic solvent composition may be comprised of water and a one or more water miscible organic solvents, such as, but not limited to, methanol, ethanol propanol, isopropanol, acetone, acetonitrile, tetrahydrofurane, dioxane, and the like. The relative amount of the water to the organic solvent may vary depending on the final composition of the suspension. In an embodiment, the aqueous organic solvent comprises water in an amount in a range from about 5% (v/v) to 65% (v/v), preferably in an amount in a range from about 20% (v/v) to 55% (v/v), more preferably in an amount in a range from about 30% (v/v) to 50% (v/v), and most preferably in an amount of about 50% (v/v). In an embodiment, the aqueous organic solvent is 50% (v/v) aqueous ethanol.

The order of mixing the various ingredients in the suspension may vary and is not limited to a specific order. In an embodiment, the crosslinking agent is added to a suspension of the plant protein powder, plasticizer, and non-proteinaceous polymer mixture. In an embodiment, the crosslinker may be added to a suspension of the plant protein powder alone. In another embodiment, the plant protein powder may be crosslinked prior to adding all other ingredients. Once the suspension mixture is prepared, the apparent pH may be adjusted to about 10 using a base such as alkali metal hydroxide, e.g., sodium hydroxide and potassium hydroxide, and the like, or by an alkali metal carbonate or a phosphate salt, and heated to a temperature in a range from about 50° C. to about 100° C., preferably in a range from about 60° C. to about 100° C., and most preferably in a range from about 70° C. to about 90° C. and held for a period of time in a range from about 2 minutes to about 20 minutes, preferably in a range from about 3 minutes to about 15 minutes, and most preferably in a range from about 5 minutes to about 10 minutes. In an embodiment, the suspension mixture is heated at about 70° C. for about 10 minutes.

After heating, the mixture may be evenly spread over flat non-sticky surface, such as, but not limited to, a silicone or Teflon®-coated surface and partially dried for a period of time at a room temperature to form a paste, wherein said period of time for drying comprises a range from about 1 day to about 4 days and preferably in a range from about 2 days to about 3 days, whereafter the partially dried paste may be transferred to a dehydrator to further dry at a temperature of about 40° C. for a period of time in a range from about 1 day to about 6 days, preferably for a time period in a range from about 2 days to 4 days, and most preferably for a time period in a range from about 2 days to about 3 days. After drying, the partially dried paste sheet is removed from the flat non-stick surface material for additional drying and/or curing.

After removal from the flat, non-stick surface, the resulting dried paste material may be molded by heat compression at a temperature in a range from about 60° C. to about 200° C., preferably in a temperature range from about 70° C. to about 150° C., more preferably in a temperature range from about 80° C. to about 140° C., and most preferably in a temperature range from about 90° C. to about 130° C., and under a pressure in a range from about 0.3 Mpa to about 5 Mpa, and for a period of time in a range from about 10 minutes to about 60 minutes, preferably in a time period range from about 10 minutes to about 45 minutes, more preferably in a time period range from about 10 minutes to 20 minutes, wherein the resulting monolayer composition material comprises a thickness in a range from about 0.5 mm to about 5.0 mm.

In an embodiment, a mixture is obtained with a minimum amount of solvent or without a solvent by mixing all ingredients cited above. The mixture is prepared, homogenized in an internal mixer, and further mixed with two-roll open mill. The mixture is further calendered a flat sheet with a thickness ranged from 0.5 to 5 mm on top of a carrier fabric and allowed to cure with a rotocure or heat press at a temperature in a range from about 60° C. to about 200° C., preferably in a temperature range from about 70° C. to about 150° C., more preferably in a temperature range from about 80° C. to about 140° C., and most preferably in a temperature range from about 90° C. to about 130° C., and under a pressure in a range from about 0.3 Mpa to about 5 Mpa, and for a period of time in a range from about 10 minutes to about 60 minutes, preferably in a time period range from about 10 minutes to about 45 minutes, more preferably in a time period range from about 10 minutes to 20 minutes, wherein the resulting monolayer composition material comprises a thickness in a range from about 0.5 mm to about 5.0 mm.

In an embodiment, the monolayer imitation leather composite material may be further finished by application of a surface coating of a finishing agent or material, which may or may not comprise a pigmented material, wherein the one or more finishing material may be comprised of polyurethane, polyurethane-polyester, acrylic resin, a cellulose ester (such as cellulose acetate, cellulose propionate, and/or cellulose butyrate), or any combination thereof. The finishing agent or material may be pigmented to add color to the imitation leather. Other useful finishing materials are tree saps. Embodiments of the invention may comprise one or more of any of the aforementioned surface coatings, each of which may be suitable for embodiments of the invention.

In an embodiment, the composite material may be finished by embossing the imitation leather composite material with different leather patterns, such as bovine, goat, alligator, crocodile, and reptile skin patterns, geometrical shapes, or animated figures.

In various embodiments of the invention, both method and composition aspects, the monolayer imitation leather composite material may comprise a foaming agent, which may be comprised of a surfactant, a blowing agent, or any combination thereof.

In various embodiments, the monolayer imitation leather may comprise wheat gluten protein in an amount in a range from about 48% (w/w) to about 52% (w/w), glycerol in an amount in a range from about 20% (w/w) to about 25% (w/w), polyurethane (as a non-proteinaceous polymer) in an amount in a range from about 7% (w/w) to about 10% (w/w), and latex in an amount in a range from about 13% (w/w) to about 20% (w/w).

In yet other embodiments, the monolayer imitation leather is biodegradable.

A second aspect of the invention is directed to a monolayer imitation leather composite material (composition) made by the embodiments of the methods and processes described herein. For example, an embodiment of the invention is directed to a monolayer imitation leather material comprising a one or more plant protein powder in an amount of at least 70% (w/w), wherein the protein content of the one or more plant protein powder comprises an amount in a range from about 28% (w/w) to about 65% (w/w), and wherein the plant protein comprises wheat gluten, brown rice protein, barley protein, maize protein, or any combination thereof, a one or more non-proteinaceous toughening polymer (elastomer) in an amount in a range from about 25% (w/w) to 50% (w/w), a one or more plasticizer in an amount in a range from about 8% (w/w) to about 25% (w/w), a one or more cross-linking agent in an amount in a range of about 1% (w/w) to about 5% (w/w) (w/w based on the weight of the protein content of the one or more plant protein powder), and a one or more curing agent in an amount in a range from about 1% (w/w) to about 10% (w/w) (w/w based on the weight of the one or more non-proteinaceous polymer), wherein the imitation leather material comprises a thickness in a range from about 0.5 mm to about 5.0 mm, a tensile strength in a range of about 1.0 Mpa to about 15 Mpa, and an elongation at break in a range of about 20% to about 200%, a tear resistance in a range from about 100 psi to 500 psi, and a Bally flex resistance in range from about 20,000 cycles to about 200,000 cycles. As detailed herein, the invention comprises multiple embodiments and variations of this composition this particular disclosed embodiment should not be construed as limiting the scope of the imitation leather material created. The scope of various embodiments of the imitation leather material is meant to encompass all such variations obtained by the disclosed methods, including the various ingredients and optional steps disclosed herein.

In an embodiment, the monolayer imitation leather comprises a crosslinked plant protein powder, wherein the plant protein powder comprises an at least 60% protein content, preferably an at least 70% protein content, more preferably an at least 75% protein content, and most preferably an at least 80% protein content; said plant protein powder comprising an amount in a range from about 28% (w/w) to about 65% (w/w), preferably in an amount in a range from about 30% to about 50% (w/w), more preferably in an amount in a range from about 45% to about 49% (w/w); a one or more plasticizer and/or lubricating agent in an amount in a range from about 8% and to 25% (w/w), preferably in an amount in a range from about 10% to about 15% (w/w).

In an embodiment, the imitation leather composite material further comprises a non-proteinaceous polymer in an amount in a range from about 25% (w/w) to about 50% (w/w).

In an embodiment, the imitation leather composite material comprises gluten protein powder comprising an at least 70% protein content in an amount in a range from about 50% (w/w) to about 54% (w/w), glycerol in an amount in a range from about 15% (w/w) to about 25% (w/w), natural rubber latex in an amount in a range from about 15% (w/w) to about 25% (w/w), and polyurethane (as a non-proteinaceous polymer) in an amount in a range from about 8% (w/w) to about 10% (w/w).

In an embodiment, the one or more non-proteinaceous polymer comprises technically specified or block natural rubber (TSR), ribbed smoked sheet natural rubber (RSS), high ammonia natural rubber latex concentrate, low ammonia natural rubber latex concentrate, deproteinized natural rubber latex concentrate with a dry rubber content in a range of about 50% to about 62%, waterborne polyurethane-polyester copolymer, polyurethane-polycarbonate copolymer, polyurethane-polyether copolymer, or any combination thereof.

In an embodiment, the imitation leather composite material comprises gluten protein powder comprising an at least 70% protein in an amount in a range from about 48% (w/w) to about 52% (w/w), glycerol (as a plasticizer) in an amount in a range from about 23% (w/w) to about 26% (w/w), polyurethane (as a non-proteinaceous polymer) in an amount in a range from about 7% (w/w) to about 10% (w/w) and latex (as a non-proteinaceous polymer together with polyurethane) in an amount in a range from about 13% (w/w) to about 17% (w/w).

In an embodiment, the crosslinked protein may be comprised of a one or more of wheat gluten, brown rice protein, barley protein, maize protein, or any combination thereof.

In an embodiment, the plasticizer is comprised of a one or more of polyol, polyethylene glycol and derivatives thereof, glycerol, urea and derivatives thereof, vegetable oils, vulcanized vegetable oils and derivatives thereof, or any combination thereof.

In an embodiment, the one or more cross-linking agent comprises dialdehyde, dicarboxylic acid esters of N-hydroxysuccinamide, carbonyldiimidazol, polycarbodiimide, peroxide curing agents or sulfur-based curing agents and accelerators, or any combination thereof. In an embodiment, the imitation leather composite material may comprise a one or more crosslinking agent in an amount in a range from about 1% (w/w) to about 10% (w/w) (with respect to the weight of the protein content of the one or more plant protein powder, i.e., crosslinking agent/plant protein ratio, based on the specific one more plant protein powder used), preferably in an amount in a range from about 1.5% (w/w) to about 8% (w/w), and most preferably in an amount in a range from about 2 (w/w) % to about 5 (w/w) %.

In an embodiment, the curing agents maybe comprised of one or more of a peroxide curing agent, a sulfur-based curing agent, stearic acid, zinc oxide, disulfiram (tetraethylthiuram disulfide or TETD), mercaptobenzothiazole disulfide (MBTS), sulfur, or any combination thereof.

In embodiments, the physical properties of the imitation leather may be engineered for a particular use. In an embodiment, the imitation leather composite material comprises a thickness in a range from about 0.5 mm to about 5.0 mm, preferably in a thickness range from about 0.5 mm to about 3 mm, and most preferably in a thickness range from about 0.7 mm to about 1.4 mm. As to the tensile strength and elongation properties, in an embodiment, the composite material may comprise a tensile strength in a range from about 1 MPa to about 15 MPa, preferably in a tensile strength range from about 3 MPa to about 15 MPa, and most preferably in a tensile strength range from about 8 MPa to about 15 MPa. In an embodiment, the imitation leather composite material comprises an elongation at a breaking point in a range from about 20% to about 200%, preferably in a breaking point range from about 50% to about 100%, a tear resistance in a range from about 100 psi to about 500 psi, and a Bally flex resistance in a range from about 20,000 cycles to about 200,000 cycles.

In an embodiment, the non-proteinaceous polymer is in an amount in a range from about 35% (w/w) to about 50% (w/w).

In an embodiment, the monolayer imitation leather material is pressed onto a backing fabric or substrate. The backing fabric or substrate is ideally an organic plant-based biodegradable fabric. The backing fabric or substrate is moved through the rollers of the calendar as the mixture is placed onto the fabric or substrate. Suitable backing fabric may comprise 100% cotton woven or interlock fabrics, Tencel® woven or interlocks, or other natural plant-based fabrics such as linen, bamboo/Tencel blend fabrics, hemp or hemp/cotton blend fabrics, or any other suitable backing as may be generally known in the art.

EXAMPLES

Example 1

Preparation of Gluten-Waterborne PU Composite Leather Mimetic

Waterborne polyurethane dispersion BONDTHANE™ UD-104, BONDTHANE™ UD-108, and BONDTHANE™ UD-301, were mixed with wheat gluten powder comprising more than 75% protein in a gluten:polymer weight ratio of 10:2.5. The mixture was plasticized with glycerin based in a gluten:glycerin ratio of 10:4 (w/w). A black pigment was added to the plasticized protein and mixed in thoroughly on a two-roll open mill. The obtained mixture was heat pressed using a manual heat press at 120° C. under 8 tons/sqft pressure for 15 minutes to form a flat sheet. The tensile strength and Elongation-at-break data are presented in Table I.

TABLE I

Tensile strength and Elongation-at-break of Gluten-PU Composite

| Preparation | Gluten Powder | Gluten protein | Glycerol | PU dispersion | PU solid | Tensile Strength (MPa) | Elongation at break |
|---|---|---|---|---|---|---|---|
| BONDTHANE ™ UD-104 | 100 | 70 | 40 | 25 | 8.75 | 7.5 ± 2.1 | 0.9 ± 0.2 |
| BONDTHANE ™ UD-108 | 100 | 70 | 40 | 25 | 8.75 | 8.1 ± 0.8 | 1.3 ± 0.2 |
| BONDTHANE ™ UD-301 | 100 | 70 | 40 | 25 | 8.75 | 3.8 ± 0.3 | 1.2 ± 0.1 |

Example 2

Preparation of Gluten-Polymer Composite Fabric with Foaming Agent:

Waterborne polyurethane dispersion (Nuvera® RU-94-227) with a solid content of 35% was mixed with wheat gluten powder comprising more than 75% protein at a dry polymer/gluten ratio of 4:6 (w/w). The mixture was plasticized with 40% glycerol based on the protein weight (w/w), crosslinked with 2% (based on total mixture weight) of polycarbodiimide (Permutex® XR-5508), and foamed with 2% (w/w based on protein weight) EXPANCEL® microspheres. The obtained mixture was calendered into flat sheet and heat press at 100° C. under 8 tons/sqft pressure for 15 minutes to form a foamed monolayer.

Example 3

Preparation of Gluten Composite Fabric with Chemical Crosslinkers:

Gluten powder was mixed with 50% aqueous ethanol on a stirring plate to obtain a 10% (w/v) suspension. Glycerin (30-40% w/w of the weight of the gluten powder) was added as plasticizer, and the pH of the solution was adjusted to 10.0 with 1M NaOH with continuous stirring. Fat liquor (5% to 10%, w/w based on the weight of gluten) and 0.05% to 0.25% (w/w based on the weight of gluten) of dye was added to the mixture before adding 2% to 10% (w/w based on dry gluten weight) of chemical crosslinkers (aldehydes, dichlorotriazine derivatives, carbodiimide crosslinkers, etc.). The mixture was heated to 70° C. for 10 minutes. The heated fabric-forming solution was then evenly spread over a silicone or Teflon®-coated plate, partially dried at room temperature for two days, and then transferred into a dehydrator and further dried at 40° C. for 2 or 3 days. The composite material obtained comprised a thickness in a range from about 0.3 to about 3.0 mm. The dried composite material was further heat pressed at 100° C. to 120° C. under 8 tons/sqft pressure for 10 minutes.

Example 4

Preparation of Gluten Composite Fabrics with Double Reactive Crosslinkers and a Dye Gluten powder was mixed with 50% aqueous ethanol on a stirring plate to obtain a 10% (w/v) suspension. Glycerol (40% w/w from the weight of the powder gluten) was added as plasticizer, and the pH of the solution was adjusted to 8.0 with sodium carbonate with continuous stirring. Ten percent (w/w based on dry gluten weight) of amine/hydroxy group double reactive crosslinkers Granofin® Easy F-90 Liq were added to the mixture, and the mixture was heated to 70° C. for 10 minutes. A dye (0.1% (w/w) based on the weight of the gluten powder) was added to the mixture. The heated solution was then evenly spread over a silicone or Teflon®-coated plate, partially dried at room temperature for two days, and then transferred into a dehydrator and further dried at 40° C. for 2 or 3 days. The obtained composite material comprised a thickness in the range from about 0.3 to about 3.0 mm, and enhanced flexibility. The tensile strength of the final product ranged from 5-8 Mpa, and the elongation at break ranged from 80% to 120%.

Example 5

Effect of Latex on the Imitation Leather Fabric:

A mixture of 50 g gluten powder containing 37.5 g protein, 25 g of glycerol, 2.5 g of Castor oil, 25 g Stahl Nuvera® RU-94-227 suspension containing 35% waterborne polyurethan (PU) in water, and varying amount of 50% natural Latex rubber suspension in water (See Table II below) was blended until it formed a homogenous dough. The mixture is calendered to form a sheet about 2 mm in thickness. The composite sheet was placed in between a Teflon® sheet and an embossing paper, then heat pressed under 8 tons/sqft pressure for 15 mins at 100° C. After the film was heat-pressed, cool the film down at room temperature and further dry the film under dehydrator at 40° C. for 24 hr. TABLE II show the maximum stress and strain at a break of the three preparations.

TABLE II[a]

| Preparation | Gluten Powder | Gluten protein | Glycerol | Castor Oil | PU dispersion | PU solid | Latex dispersion | Tensile strength (MPa) | Elongation-at-break |
|---|---|---|---|---|---|---|---|---|---|
| 1 | 50 | 37.5 | 25 | 2.5 | 25 | 8.75 | 0 | 3.8 ± 1.1 | 0.9 ± 0.2 |
| 2 | 50 | 37.5 | 25 | 2.5 | 25 | 8.75 | 15 | 3.5 ± 1.0 | 1.2 ± 0.3 |
| 3 | 50 | 37.5 | 25 | 2.5 | 25 | 8.75 | 25 | 2.7 ± 0.9 | 1.7 ± 0.3 |

[a]The amounts listed in the table are measured in grams.

Example 6

Preparation of Gluten-Natural Rubber Composite with Curing Agents

A uniform mixture of 500 g of wheat gluten powder, 250 g glycerin and 400 g of CV60 natural rubber and 45 g of coffee cherry powder was obtained by mixing in an internal mixer followed by a two-roll open mill. Curing agents including 5 phr (parts per hundred rubber) zinc oxide, 2 phr stearic acid, 0.2 phr tetramethylthiuram disulfide, 1 phr benzothiazyl disulfide and, 2.75 phr sulfur were added to the mixture. The mixture was calendared into 1.0 mm flat sheet on a woven cotton carrier fabrics and then cured with the carrier fabric at 120° C. for 15 min at pressure of 8 tons/sqft.

Example 7

Preparation of Gluten-Natural Rubber Latex Composite with Curing Agents

A uniform mixture of 500 g of wheat gluten powder, 250 g glycerin and 500 g of low ammonia natural rubber latex (dry rubber content 55%) was obtained by mixing in an internal mixer. Curing agents including 3 phr (parts per hundred dry rubber content) zinc oxide, 1 phr stearic acid, 0.5 phr zinc diethyldithiocarbamate, and 1 phr sulfur were added to the mixture and blending for 10 min. The mixture was calendered into 2 mm flat sheet and then compression-molded at 100° C. for 15 min at pressure of 8 tons/sqft.

Example 8

12-Week Aerated Compost Test

A 12-week aerated composting simulation was conducted in order to observe the biodegradability of Uncaged bioleather described in Example 5.

Small Scale Composter Preparation a. 1-liter clear containers were filled with equal parts soil, green scraps (fresh leaves, coffee grounds, fruit and vegetable scraps), and brown scraps (dry leaves, dry pine needles)
b. Holes were drilled in the bottoms of containers and the composters were elevated during the study to allow air flow Uncaged bioleather samples were dried for 1 hour at 122° F. to stabilize moisture content. Sample weights were recorded, the pieces were buried in the composters and the tops of the composters were sealed. Control samples for each scenario were left in open petri dishes in same environment as composters. Environmental conditions during the study were ambient temperature and humidity. Composters were inverted and shaken weekly to mix compost. At the end of 8 weeks, samples were removed from compost and dried for 1 hour at 122° F. before being weighed. Table III shows the data of starting and remaining weight of the materials after 12-weeks aerated compost.

Example 9

Preparation of Gluten-Polymer Composite Fabric

Thermal plastic polyurethane (PU) particles were mixed with wheat gluten powder containing more than 75% protein at a gluten/polymer weight ratio of 6/4. The mixture was plasticized with 40% glycerin based on the protein weight (w/w) and crosslinked with 2% (based on total mixture weight) of polycarbodiimide (Permutex® CR-5508). A black pigment was added to the mixture and mixed in an internal mixer for 5 minutes. The obtained mixture was calendered into flat sheet and heat press at 100° C. under 8 ton/sqft pressure for 15 minutes to form a monolayer.

Example 10

Preparation of Gluten-Polymer Composite with a Foaming Agent:

Waterborne polyurethane dispersion (Nuvera® RU-94-227) with solid content of 35% were mixed with wheat gluten powder containing more than 75% protein at a dry polymer/gluten ratio of 4:6 (w/w). The mixture was plasticized with 40% glycerol based on the protein weight (w/w), crosslinked with 2% (based on total mixture weight) of polycarbodiimide (Permutex® XR-5508), and foamed with 2% (w/w based on protein weight) EXPANCEL® microspheres. A black pigment was added to the mixture and mixed in an internal mixer for 5 minutes. The obtained mixture was calendered into flat sheet and heat press at 100° C. under 8 ton/sqft pressure for 15 minutes to form a foamed monolayer.

Example 11

Preparation of Gluten-Polymer Composite with Curing Agents

A uniform mixture of 500 g of wheat gluten powder, 250 g glycerin and 500 g of low ammonia natural rubber latex (dry rubber content 55%) was obtained by mixing in an internal mixer. Curing agents including 1 phr (parts per hundred rubber) zinc oxide, 1 phr stearic acid, 0.5 phr zinc diethyldithiocarbamate, and 1 phr sulfur were added to the mixture and blending for 10 min. The mixture was calendered into 2 mm flat sheet on top of a Tencel interlock fabric and then cured on top of the carrier fabric at 100° C. for 15 min at pressure of 8 tons/sqft.

Example 12

Preparation of Gluten-Polymer Composite with Natural Rubber

A uniform mixture of 500 g of wheat gluten powder, 250 g glycerin and 400 g of CV60 natural rubber and 45 g of coffee cherry powder was obtained by mixing in an internal mixer followed by a two-roll open mill. Curing agents TABLE III[a]

| Preparation | Gluten Powder | Gluten protein | Glycerol | Castor Oil | PU dispersion | PU solid | Latex dispersion | Latex solid | % weight reduction after 12-weeks |
|---|---|---|---|---|---|---|---|---|---|
| 1 | 50 | 37.5 | 25 | 2.5 | 25 | 8.75 | 0 | 0 | 81% |
| 2 | 50 | 37.5 | 25 | 2.5 | 25 | 8.75 | 15 | 9.5 | 75% |
| 3 | 50 | 37.5 | 25 | 2.5 | 25 | 8.75 | 25 | 15.25 | 55% |

[a]The amounts listed in the table are measured in grams.

including 5 phr (parts per hundred rubber) zinc oxide, 1.5 phr stearic acid, 0.5 phr tetramethylthiuram disulfide, 0.5 phr zinc diethyldithiocarbamate and 2 phr sulfur were added to the mixture. The mixture was calendered into 1.5 mm flat sheet on top of a woven cotton fabric and then cured at with the carrier fabric at 120° C. for 15 min at pressure of 5 tons/sqft.

What is claimed is:

1. A method of producing a monolayer imitation leather material, comprising:

combining into a mixture, a one or more plant protein powder in an amount in a range of about 28% to about 65% (w/w), wherein the one or more plaint protein powder comprises an at least 70% protein content and wherein the one or more plant protein powder is comprised of wheat gluten, brown rice protein, barley protein, maize protein, or any combination thereof, a one or more non-proteinaceous polymer in an amount in a range of about 25% to about 50% (w/w), wherein the one or more non-proteinaceous polymer comprises technically specified or block natural rubber (TSR), ribbed smoked sheet natural rubber (RSS), high ammonia natural rubber latex concentrate, low ammonia natural rubber latex concentrate, deproteinized natural rubber latex concentrate with a dry rubber content in a range of about 50% to about 62%, waterborne polyurethane-polyester copolymer, polyurethane-polycarbonate copolymer, polyurethane-polyether copolymer, or any combination thereof, a one or more plasticizer in an amount in a range of about 8% to about 25% (w/w), a one or more cross-linking agent in an amount in a range of about 1% to about 5% (w/w, based on a weight of the protein content of the one or more plant protein powder), and a curing agent in an amount in a range of about 1% to about 10% (w/w, based on a weight of the one or more non-proteinaceous polymer), calendering the mixture into a monolayer sheet, wherein the calendering is conducted at a controlled roll temperature in a range from about 35° C. to 90° C., and wherein the calendered monolayer sheet is affixed onto a surface of a carrier fabric, and wherein the calendered monolayer sheet comprises a thickness in a range from about 0.5 mm to about 5 mm, and curing the calendered monolayer sheet at a temperature in a range from about 100° C. to about 160° C., at a pressure in a range from about 0.3 Mpa to about 5 Mpa, and for a period of time in a range from about 10 minutes to about 60 minutes.

2. The method of claim 1, wherein the one or more plasticizer comprises glycerin, polyethylene glycol 400~4000, vegetable oil, vulcanized vegetable oil, or any combination thereof.

3. The method of claim 1, wherein the one or more crosslinking agent comprises dialdehyde, dicarboxylic acid esters of N-hydroxysuccinamide, carbonyldiimidazol, polycarbodiimide, or any combination thereof.

4. The method of claim 1, wherein the one or more curing agent comprises a peroxide curing agent, a sulfur-based curing agent, stearic acid, zinc oxide, disulfiram (tetraethylthiuram disulfide or TETD), mercaptobenzothiazole disulfide (MBTS), sulfur, or any combination thereof.

5. The method of claim 1, wherein the mixture further comprises a one or more lubricating agent in an amount wherein a combined amount of the one or more lubricating agent and the one or more plasticizer is in a range of about 8% to about 25% (w/w).

6. The method of claim 5, wherein the one or more lubricating agent comprises stearic fatty acid, palmitic fatty acid, and myristic fatty acid and derivatives and salts thereof, paraffin wax, low molecular weight polyethylene, silicon lubricants, surfactants, or any combination of the foregoing.

7. The method of claim 1, wherein a one or more finishing material is applied to a surface of the monolayer sheet in a thickness in a range from about 5 μm to about 50 μm and wherein the finishing material comprises polyurethane, polyurethane-polyester, polyurethane-polycarbonate, acrylic resin, or any combination thereof.

8. A monolayer imitation leather comprising, a one or more plant protein powder in an amount in a range of about 28% to about 65% (w/w), wherein the one or more plant protein powder comprises an at least 70% protein content, and wherein the one or more plant protein comprises wheat gluten, brown rice protein, barley protein, maize protein, or any combination thereof, a one or more non-proteinaceous polymer in an amount in a range from about 25% to about 50% (w/w), wherein the one or more non-proteinaceous polymer comprises technically specified or block natural rubber (TSR), ribbed smoked sheet natural rubber (RSS), high ammonia natural rubber latex concentrate, low ammonia natural rubber latex concentrate, deproteinized natural rubber latex concentrate comprising a dry rubber content in an amount in a range from about 50% to about 62%, waterborne polyurethane-polyester copolymer, polyurethane-polycarbonate copolymer, polyurethane-polyether copolymer, or any combination thereof, a one or more plasticizer in an amount in a range from about 8% to about 25% (w/w), a one or more cross-linking agent in an amount in a range of about 1% to about 5% (w/w, based on a weight of the protein content of the one or more plant protein powder), and a one or more curing agent in an amount in a range from about 1% to about 10% (w/w, based on a weight of the one or more non-proteinaceous polymer).

9. The monolayer imitation monolayer leather of claim 8, wherein the monolayer imitation leather comprises a thickness in a range from about 0.5 mm to about 5.0 mm, a tensile strength in a range from about 1.0 Mpa to 15 Mpa, an elongation at break in a range from about 20% to about 200%, a tear resistance in a range from 100 psi to 500 psi, and a Bally flex resistance in a range from 20,000 cycles to 200,000 cycles.

10. The monolayer imitation leather of claim 8, wherein the one or more plasticizer comprises glycerin, polyethylene glycol 400~4000, vegetable oil, vulcanized vegetable oil, or any combination thereof.

11. The monolayer imitation leather of claim 8, wherein the one or more curing agent comprises dialdehyde, dicarboxylic acid esters of N-hydroxysuccinamide, carbonyldiimidazol, polycarbodiimide, or any combination thereof.

12. The monolayer imitation leather of claim 11, wherein the one or more curing agent comprises a peroxide curing agent, a sulfur-based curing agent, stearic acid, zinc oxide, disulfiram (tetraethylthiuram disulfide or TETD), mercaptobenzothiazole disulfide (MBTS), sulfur, or any combination thereof.

13. The monolayer imitation leather of claim 8, further comprising a one or more lubricating agent in an amount wherein a combined amount of the one or more lubricating agent and the one or more plasticizer is in a range of about 8% to about 25% (w/w).

14. The monolayer imitation leather of claim 13, wherein the one or more lubrication agent comprises stearic fatty acid, palmitic fatty acid, and myristic fatty acid and derivatives and salts thereof, paraffin wax, low molecular weight polyethylene, silicon lubricants, surfactants, or any combination of the foregoing.

15. The monolayer imitation leather of claim 8, wherein the one or more non-proteinaceous polymer is in an amount in a range from about 38% to about 50% (w/w).

* * * * *